US012018561B2

(12) United States Patent
Sperle et al.

(10) Patent No.: US 12,018,561 B2
(45) Date of Patent: Jun. 25, 2024

(54) TRACER RELEASE SYSTEM AND METHOD OF DETECTION

(71) Applicant: RESMAN AS, Ranheim (NO)

(72) Inventors: Thomas Sperle, Ranheim (NO); Øystein Mølstre, Ranheim (NO)

(73) Assignee: Resman AS, Ranheim (NO)

( * ) Notice: Subject to any disclaimer, the term of this patent is extended or adjusted under 35 U.S.C. 154(b) by 95 days.

(21) Appl. No.: 17/613,764

(22) PCT Filed: May 23, 2020

(86) PCT No.: PCT/EP2020/064349
§ 371 (c)(1),
(2) Date: Nov. 23, 2021

(87) PCT Pub. No.: WO2020/239649
PCT Pub. Date: Dec. 3, 2020

(65) Prior Publication Data

US 2022/0228479 A1 Jul. 21, 2022

(30) Foreign Application Priority Data

May 24, 2019 (GB) ..... 1907370

(51) Int. Cl.
*E21B 47/11* (2012.01)
*E21B 34/06* (2006.01)
*E21B 34/08* (2006.01)

(52) U.S. Cl.
CPC ..... *E21B 47/11* (2020.05); *E21B 34/066* (2013.01); *E21B 34/08* (2013.01)

(58) Field of Classification Search
CPC ..... E21B 47/11; E21B 34/066; E21B 34/08; E21B 43/14; G01F 1/74; G01F 1/7086; G01N 21/64
See application file for complete search history.

(56) References Cited

U.S. PATENT DOCUMENTS

2003/0056952 A1* 3/2003 Stegemeier ..... E21B 47/113 166/250.12
2004/0060703 A1* 4/2004 Stegemeier ..... E21B 47/13 166/310
2011/0277996 A1* 11/2011 Cullick ..... E21B 43/16 166/250.12

FOREIGN PATENT DOCUMENTS

WO WO 2018143814 * 8/2018 ..... E21B 47/10

* cited by examiner

*Primary Examiner* — Yong-Suk (Philip) Ro
(74) *Attorney, Agent, or Firm* — FisherBroyles, LLP

(57) ABSTRACT

The invention provides a method of monitoring influx of a fluid to a hydrocarbon producing well comprising providing at least one tracer release apparatus (100) in a hydrocarbon producing well at an influx location (14*a*-14*d*). The at least one tracer release apparatus comprises a fluid volume (121) and a tracer material (124) located in the fluid volume. The method comprises shutting in the tracer release apparatus during production to increase the concentration of tracer molecules in the fluid volume; releasing the tracer molecules from the tracer release apparatus into the production flow and detecting the presence of tracer downstream of the influx location.

27 Claims, 21 Drawing Sheets

TRACER RELEASE SYSTEM AND METHOD OF DETECTION

This application is the U.S. National Stage of International Application No. PCT/EP2020/064349, which was filed on May 23, 2020. This application also claims the benefit of the filing date of GB patent application No. GB1907370.9, which was filed on May 24, 2019. The contents of both of those applications are hereby incorporated by reference.

The present invention relates to apparatus and method for releasing tracer into a production well for flow measurement and monitoring wellbore inflow profiles during production. Aspects of the invention include a tracer release apparatus to store and selectively release the tracer and a method of tracer detection.

BACKGROUND TO THE INVENTION

Downhole tracers installed in producer wells have been proven for estimating which fluids flow in which parts of the well, and at which flow rates. Traditionally, different tracers have been placed in different influx zones to a production completion installed in a well.

Methods of monitoring fluid rate in a well are known, including quantification based on transient flow where distinct tracers are arranged at different influx zones in a well. The well is shut-in for a period of time to allow a high concentration of tracers to build up at the individual influx zones, and then the well is re-started to carry the tracers to surface. Sampling and analysis of the concentration of the different tracers is used to provide qualitative and quantitative production data.

EP2633152 discloses a method of estimating influx profile for well fluids (oil, gas, or water) to petroleum well with influx locations to a production flow. The method comprises arranging tracer sources with tracer materials in levels of the well, arranged downstream and inducing a transient in the production rate of the entire production flow by shutting in the well. The method comprises collecting and analysing samples and based on said concentrations and their sampling sequence and the well geometry, calculating influx volumes from flow models.

However, these methods limit the number of opportunities for obtaining tracer data, as shutting in the well is a complex and highly expensive operation requiring significant project planning and resulting in loss of revenue due to interruption to production.

Another problem of known downhole tracer techniques is that due to the downhole conditions pressure variations can exist in the well which can affect the flow of the tracers downhole. This can result in situations where tracers travel upstream or flow into other zones in the formation which is known cross-flow. Cross flow presents uncertainties and can affect the accuracy of flow rate analysis.

Tracer injection systems for downhole use are known from U.S. Pat. No. 6,840,316 B2 and WO2016/137328A1 where an injector unit releases tracer molecules or particles into the flow.

WO2018/143814 describes a tracer injection system for use in a well where at least two injection devices are arranged at different locations in the well and the tracers are released in a synchronized manner to allow flow characteristics of the well to be determined.

Disadvantages of known techniques are that tracers are added to the flow in response to timed release and there are limited control downhole whether the tracers hit the target fluid or not and the analysis topside are left with some uncertainties.

Downhole injection systems have limitations on the amount of tracer and type of tracer that can be stored and released in the injector apparatus.

There are limitations on the types of tracer that may be used in downhole applications. The tracers are required to be released at a high concentration to allow detection at surface but also not be depleted quickly and have a long lifespan downhole.

A further disadvantage is that downhole injection systems are typically deployed via a downhole tool which may obstruct or hinder production flow and affect flow measurements. The downhole hole tool may also become stuck downhole requiring costly retrieval operations

SUMMARY OF THE INVENTION

It is amongst the aims and objects of the invention to provide a method of monitoring influx of a fluid to a hydrocarbon producing well tracer by detecting the presence of tracer selectively released into the production flow of the well.

It is another object of the present invention to provide a tracer release apparatus for selectively releasing tracer into the production flow to allow flow measurement and wellbore inflow profiles to be calculated and monitored.

It is further object of the present invention to provide a tracer release apparatus which is capable of building up a high concentration of tracer and selectively releasing the high concentration of tracer without requiring the well to be shut in. The high concentration of tracer being detectable downstream of the tracer release apparatus.

It is another object of an aspect of the invention to provide a tracer release apparatus which is capable of releasing a high concentration of tracer into the production flow as a tracer cloud which can be detected at surface but also controls the exposure of the tracer source to production fluid to extend the lifespan of the tracer downhole.

It is a further object of an aspect of the invention to provide a method and apparatus to selectively release a high concentration of tracer that can be detected by sampling and/or real time analysis methods.

Another object of the invention an aspect of the invention to provide a tracer release apparatus which controllably releases tracer by adjusting production flow at surface.

Further aims and objects of the invention will become apparent from reading the following description.

According to a first aspect of the invention, there is provided a method of monitoring influx of a fluid to a hydrocarbon producing well, the method comprising:

providing at least one tracer release apparatus connected to a production tubing in a hydrocarbon producing well at an influx location, the tracer release apparatus comprising: a fluid volume; at least one tracer material located in the fluid volume; at least one outlet to the fluid volume; and at least one controllable valve configured to selectively control the flow of fluid through the at least one outlet;

wherein the tracer release apparatus has a first condition in which the at least one controllable valve is closed to substantially or fully prevent fluid and tracer from passing from the fluid volume to the production fluid via the at least one outlet, and a second condition in which the at least one controllable valve is open to enable fluid and tracer to pass from the fluid volume to the production tubing via the at least one outlet; the method comprising:

producing hydrocarbons from the well with the tracer release apparatus in its first condition at a first production flow rate in the production tubing;

modifying the production flow rate in the production tubing to a second production flow rate to actuate the at least one controllable valve to cause fluid and the tracer to flow from the fluid volume to the production tubing, creating an increased concentration of tracer in the production tubing;

detecting the presence of tracer downstream of the influx location.

By providing a tracer release apparatus with at least one valve configured to selectively control the flow of fluid through the at least one outlet may allow the apparatus to be shut in to increase the concentration of tracer molecules in a fluid volume of the apparatus. The subsequent opening of the valve to release the increased concentration of tracer may create a tracer transient. The increased concentration of tracer molecules propagates downstream with production flow as a tracer cloud, slug or shot which may be detectable downstream of the apparatus and/or topside as tracer response signal or spike at the downstream detection point.

The tracer transients are driven by the velocity field in the well. The topside arrivals of the onset of the different tracers, or the full transient of the different tracers, can be used to estimate the downhole velocity field. From the velocity field the inflow profile may be calculated.

The method may comprise collecting samples of the production flow. The sampling may be conducted at one or more sampling times. The sampling may be conducted downhole downstream of the tracer release apparatus or at surface. Samples may be collected for later analysis. The method may comprise estimating or calculating an influx profile based on the concentration and type of tracer as a function of the sampling time.

Based on the measured tracer concentrations and their sampling sequence and the well geometry the influx volumes may be calculated. The influx volumes may be calculated from transient flow models. The influx volumes may be used to estimate an influx profile of the well.

The method may comprise detecting the presence of tracer in the production flow downstream of the influx location in real time. The method may comprise monitoring influx of a fluid to a hydrocarbon producing well in real time.

The method may comprise conducting optical monitoring for the detection of the tracers in the production flow. The method may comprise determining the type of tracer. The method may comprise the measuring and/or monitoring the concentration of tracer.

The method may comprise analysing characteristics of the tracer release, sampling time, and/or cumulative produced volume of the influx volumes from different influx zones.

The method may comprise analysing the arrival of the concentration peaks of each tracer to determine the percent of inflow that occurs between tracer locations. The method may comprising analysing the rate of decline of the tracer concentration from each tracer location to determine the percent of reservoir inflow from each influx zone.

The method may comprise detecting the presence of tracer material at a detection location. The detection location may be a downhole location, or may be a surface location, or may be at a location in a direction towards the surface of the production well.

The method may comprise modelling the influx rates in a model well. The modelled influx profile and/or rates may be adjusted until the calculated concentrations of model tracers compare with the measured concentrations of identified tracers to estimate an influx profile.

The method may comprise modifying the production flow rate in the production tubing to a third production flow rate to actuate the controllable valve to prevent fluid and tracer material from passing from the fluid volume to the production fluid via the outlet.

The second production flow rate may be higher than the first production flow rate. Alternatively, the second production flow rate may be lower than the first production flow rate. The third production flow rate may be higher than the second production flow rate. Alternatively, the third production flow rate may be lower than the second production flow rate.

Preferably the tracer release apparatus has an at least one inlet to the fluid volume.

The method may comprise actuating the at least one controllable valve to open the at least one inlet and/or at least one outlet. The method may comprise actuating the at least one controllable valve to close the inlet and/or outlet. The at least one controllable valve may be disposed in the at least one outlet between the fluid volume and the production tubing. The at least one controllable valve may be disposed in the at least one inlet between the fluid volume and the production tubing.

The apparatus may comprise a first controllable valve disposed in the outlet between the fluid volume and the production tubing and a second controllable valve disposed in the inlet between the fluid volume and the production tubing. The method may comprise actuating the controllable valve to open the inlet and/or outlet. The method may comprise actuating the controllable valve to close the inlet and/or outlet.

The first, second and third production flow rates may be non-zero flow rates. At least one of the first, second and/or third flow rates may be a zero flow rate. The production flow rate may be modified by operation of a choke connected to the production tubing. The choke may be a subsea choke or a surface choke. The choke may be a downhole choke.

The third production flow rate may be substantially the same as the first production flow rate. Thus, the controllable valve may be actuated to open by a temporary modification of a production flow rate to a higher or lower production flow rate.

The tracer release apparatus may have a third condition in which the at least one controllable valve is at an intermediate position between the fully open and fully closed to enable the throttling of flow of the fluid and tracer materials passing from the fluid volume to the production tubing via the outlet.

By providing an apparatus capable of controlling the building up and selective release of a high concentration of tracer a detectable level of tracer may be monitored downstream as required.

The method may comprise closing the valve of at least one tracer release apparatus for a period of time to shut in the tracer release apparatus. By shutting in the tracer release apparatus the concentration of tracer particles or molecules released into the fluid volume or flow passage of the tracer release apparatus increases until the volume of fluid in the flow passage becomes enriched or saturated with tracer particles.

The method may comprise shutting in the tracer release apparatus for a period of time. The period of time may range from hours to months.

The method may comprise closing the valve for less than 24 hours to shut in the tracer release apparatus. The method may comprise closing the valve for more than 24 hours to shut in the tracer release apparatus. The method may comprise opening the valve to release fluid and tracer particles or molecules from the flow passage through the outlet into the production flow.

The method may also comprise controlling the exposure of the tracer material to production flow to extend the lifespan of downhole tracer. During a shut in of the tracer release apparatus the tracer molecules may be released into the fluid volume of the apparatus until the fluid volume becomes enriched or saturated with tracer molecules. After the fluid volume is enriched or saturated with tracer molecules the release of tracer into the fluid volume may be substantially or fully stopped.

The method may also allow tracer systems which previously have been considered unsuitable due to a high of rate of release from a tracer source into a target fluid in downhole conditions to be used. In fact, the high release rate of such tracers may allow high tracer concentrations to be built up in a short period of time. This may be beneficial where tracer flow analysis operations are required in quick succession.

According to a second aspect of the invention there is provided a method of monitoring influx of a fluid to a hydrocarbon producing well in real-time, the method comprising:

providing at least one tracer release apparatus connected to a production tubing in a hydrocarbon producing well at an influx location, the tracer release apparatus comprising:

a fluid volume;

at least one tracer material located in the fluid volume;

at least one outlet to the fluid volume;

and a controllable valve configured to selectively control the flow of fluid through the outlet;

wherein the tracer release apparatus has a first condition in which the at least one controllable valve is closed to substantially or fully prevent fluid and tracer from passing from the fluid volume to the production fluid via the outlet, and a second condition in which the at least one controllable valve is open to enable fluid and tracer to pass from the fluid volume to the production tubing via the outlet;

the method comprising:

producing hydrocarbons from the well with the tracer release apparatus in its first condition at a first production flow rate in the production tubing;

modifying the production flow rate in the production tubing to a second production flow rate to actuate the controllable valve to cause fluid and the tracer to flow from the fluid volume to the production tubing, creating an increased concentration of tracer material in the production tubing;

detecting the presence of tracer downstream of the influx location.

The method may comprise detecting the presence of tracer at a detection location. The detection location may be a downhole location, or may be a surface location, or may be at a location in a direction towards the surface of the production well.

The method may comprise modifying the production flow rate in the production tubing to a third production flow rate to actuate the at least one controllable valve to close the outlet and substantially or fully prevent fluid and tracer material from passing from the fluid volume to the production fluid via the outlet.

The method may comprise optically detecting the tracer. The method may comprise emitting light from a light source into the production flow. The method may comprise receiving light from generated from a tracer-specific luminescence in the tracers present in the flow. The method may comprise collecting and analysing the backscattered light signal. The method may comprise transporting the production flow from the downhole tracer release locations to a real-time detector in the production flow at a detection point downstream of tracer release apparatus.

The method may comprise conducting optical monitoring for detection of the tracers in the production flow. The method may comprise determining the type of tracer. The method may comprise the measuring and/or monitoring the concentration of tracer. The method may comprise monitoring the arrival times of the tracer.

The detection may be performed by monitoring at a detection point downhole. The monitoring may also, or instead, be performed at a detection point topside.

The method may comprise monitoring by detection equipment and or detection, in-line, in flow stream, clamp on measurement or the like. Such monitoring may be more or less continuous and will catch or detect tracer signal whenever they occur. The monitoring may be performed by analysing withdrawn or collected fluid samples. This may require tracer release at a planned time or an automated sampling device because manually sampling may be quite resource demanding.

The at least one controllable valve may be disposed in the outlet between the fluid volume and the production tubing. The at least one controllable valve may be disposed in the inlet between the fluid volume and the production tubing. Controllable valves may be disposed in the inlet and the outlet between the fluid volume and the production tubing.

The tracer material may be configured to selectively release tracer molecules from the tracer material into a fluid in the tracer chamber on contact with a particular well fluid. The tracer material may be configured to release tracer molecules from the tracer material into a fluid in the tracer chamber on contact with a target well fluid.

Preferably the tracer material is designed to release tracer molecules into the tracer chamber when the tracer material is exposed to a target fluid i.e. oil, gas or water. The tracer material may be a solid, liquid or gas.

The tracer material may be selected from the group comprising chemical, fluorescent, phosphorescent, magnetic, DNA and/or radioactive compounds.

The tracer material may comprise chemical tracers selected from the group comprising perfluorinated hydrocarbons or perfluoroethers.

The perfluorinated hydrocarbons may be selected from the group of perfluoro buthane (PB), perfluoro methyl cyclopentane (PMCP) and/or perfluoro methyl cyclohexane (PMCH). The tracer material may comprise a dye. The tracer material may comprise a luminescent dye.

Embodiments of the second aspect of the invention may include one or more features of the first aspect of the invention or its embodiments, or vice versa.

According to a third aspect of the invention there is provided a method of monitoring influx of a fluid to a hydrocarbon producing well in real-time, the method comprising:

providing at least one tracer release apparatus connected to a production tubing in a hydrocarbon producing well at an influx location, the tracer release apparatus comprising: a fluid volume; at least one tracer material located in the fluid volume; at least one outlet to the fluid volume; and at least one controllable valve disposed in the at least one outlet between the fluid volume and the production tubing;

wherein the at least one tracer release apparatus has a first condition in which the at least one controllable valve is closed to substantially or fully prevent fluid and tracer from passing from the fluid volume to the production fluid via the at least one outlet, and a second condition in which the at least one controllable valve is open to enable fluid and tracer to pass from the fluid volume to the production tubing via the at least one outlet; the method comprising:

producing hydrocarbons from the well with the at least one tracer release apparatus in its first condition at a first production flow rate in the production tubing;

modifying the production flow rate in the production tubing to a second production flow rate to actuate the controllable valve to open the outlet and cause fluid and the tracer material to flow from the fluid volume to the production tubing, creating an increased concentration of tracer in the production tubing;

detecting the presence of tracer downstream of the influx location at a detection location in a direction towards the surface of the production well.

The method may comprise optically detecting the tracer. The method may comprise emitting light from a light source into the production flow. The method may comprise receiving light from generated from a tracer-specific luminescence in the tracers present in the flow. The method may comprise collecting and analysing the backscattered light signal The method may comprise allowing the transport of the production flow from the downhole tracer release locations to a real-time detector in the production flow at a detection point downstream of tracer release apparatus.

The method may comprise conducting optical monitoring for detection of the tracers in the production flow. The method may comprise determining the type of tracer. The method may comprise the monitoring the concentration of tracer. The method may comprise monitoring the arrival times of the tracer.

Embodiments of the third aspect of the invention may include one or more features of the first or second aspect of the invention or its embodiments, or vice versa.

According to a fourth aspect of the invention there is provided a method of monitoring influx of a fluid to a hydrocarbon producing well, the method comprising:

providing two or more tracer release apparatus connected to a production tubing in a hydrocarbon producing well each tracer release apparatus at a different influx location, the tracer release apparatus comprising:

a fluid volume; at least one tracer material located in the fluid volume; at least one outlet to the fluid volume; and at least one controllable valve configured to selectively control the flow of fluid through the at least one;

wherein each tracer release apparatus has a first condition in which the at least one controllable valve is closed to substantially or fully prevent fluid and tracer from passing from the fluid volume to the production fluid via the at least one outlet, and a second condition in which the at least one controllable valve is open to enable fluid and tracer to pass from the fluid volume to the production tubing via the at least one outlet; the method comprising:

producing hydrocarbons from the well with the tracer release apparatus in its first condition at a first production flow rate in the production tubing;

modifying the production flow rate in the production tubing to a second production flow rate to actuate the at least one controllable valve to cause fluid and the tracer to flow from the fluid volume to the production tubing, creating an increased concentration of tracer in the production tubing;

detecting the presence of tracer downstream of the influx location at a detection location in a direction towards the surface of the production well.

The method may comprise collecting samples of the production flow. The sampling may be conducted at the one or more of said sampling times. The sampling may be conducted downhole downstream of the tracer release apparatus or at surface. Samples may be collected for later analysis.

The method may comprise monitoring influx of a fluid to a hydrocarbon producing well in real time.

The method may comprise conducting optical monitoring for detection of the tracers in the production flow. The method may comprise determining the type and/or concentration of tracer. The method may comprise monitoring the concentration of tracer. The method may comprise monitoring the arrival times of the tracer.

The method may comprise analysing characteristics of the tracer release, sampling time, and/or cumulative produced volume of the influx volumes from different influx zones.

The method may comprise analysing the arrival of the concentration peaks of each tracer to determine the percent of inflow that occurs between tracer locations. The method may comprise analysing the rate of decline of the tracer concentration from each tracer location and/or tracer release apparatus location to determine the percent of reservoir inflow from each influx zone.

The method may comprise calculating or estimating an influx profile based on the type of tracer and the measured tracer concentrations. The method may comprise using the calculated or estimated influx profile as parameters for controlling the production flow or for characterizing the reservoir.

The method may comprise modelling the influx rates in a model well. The modelled influx profile and/or rates may be adjusted until the calculated concentrations of model tracers compare with the measured concentrations of identified tracers to estimate an influx profile.

The method may comprise optically detecting the tracer.

The method may comprise releasing high concentrations of tracer from each tracer release apparatus substantially simultaneously into the local production flow. The method may comprise releasing high concentrations of tracer from each tracer release apparatus in a staggered or sequential manner into the local production flow.

The method may comprise measuring the concentration of tracer and estimating an influx profile based on the type of tracer, the measured tracer concentrations and characteristics of the tracer release, sampling time, and/or cumulative produced volume of the influx volumes from different influx zones.

The method may comprise actuating the valve in response to a pressure differential between the fluid volume and the production tubing.

The method may comprise actuating the valve in response to a change in the flow rate of the production flow.

Embodiments of the fourth aspect of the invention may include any of features of the first to third aspects of the invention or their embodiments, or vice versa.

According to a fifth aspect of the invention, there is provided a tracer release system for monitoring influx of a fluid to a producing petroleum well comprising at least one tracer release apparatus for connection to a production tubing, the at least one tracer release apparatus comprising at least one outlet;

at least one tracer chamber in fluid communication with the at least one outlet;

a tracer material located in the tracer chamber; and at least one valve configured to selectively control the flow of fluid through the at least one outlet.

The at least one tracer release apparatus may comprise at least one inlet. The at least one inlet may be in fluid communication with the at least one tracer chamber. The at least one valve may be configured to selectively control the flow of fluid through the at least one inlet The at least one valve may be configured to selectively open and close the at least one inlet and/or outlet to control the flow of fluid through the at least one inlet and/or outlet. The at least one valve may be configured to selectively open and close the at least one inlet between a fully open position, a fully closed position, or to an intermediate position between the fully open and fully closed position.

The at least one valve may be configured to selectively open and close the at least one outlet between a fully open position, a fully closed position, or to an intermediate position between the fully open and fully closed positions.

The at least one valve may be operated to control flow and vary the area of openings for flow through the at least one inlet and/or through the at least one outlet.

The tracer material may be configured to selectively release tracer molecules from the tracer material into a fluid into the tracer chamber on contact with a particular well fluid.

Preferably the tracer material is designed to release tracer molecules into the tracer chamber when the tracer material is exposed to a target fluid i.e. oil, gas or water. The tracer material may be a solid, liquid or gas.

The tracer material may be selected from the group comprising chemical, fluorescent, phosphorescent, magnetic, DNA and radioactive compounds.

The tracer material may comprise chemical tracers selected from the group comprising perfluorinated hydrocarbons or perfluoroethers.

The perfluorinated hydrocarbons may be selected from the group of perfluoro buthane (PB), perfluoro methyl cyclopentane (PMCP) and/or perfluoro methyl cyclohexane (PMCH).

The tracer material may comprise a luminescent dye. The tracer material may be chemically immobilized within the tracer chamber.

The tracer material may comprise a tracer and a carrier. The carrier may be a matrix material. The matrix material may be a polymeric material.

The tracer may be chemically immobilized within the carrier. The tracer material may be chemically immobilized by a chemical interaction between the tracer and the carrier. The tracer material may be chemically immobilized in a way that it releases tracer molecules or particles in the presence of a chemical trigger. By varying the chemical interaction between the tracer and the polymer release mechanism and the rate of release of tracer molecules from the tracer material may be controlled. Preferably the tracer is released from the tracer carrier with an even release rate.

The carrier may be a selected from poly methyl methacrylates (PMMA), poly methylcrylates, poly ethylenglycols (PEG), poly lactic acid (PLA) or poly glycolic acid (PGA) commercially available polymers or copolymers thereof.

The carrier may be selected from polymers with higher rates of tracer release such as polyethylene and polypropylene.

The tracer material may be physically dispersed and/or physically encapsulated in the carrier.

The tracer material may release tracer molecules into fluid by dissolution or degradation of the carrier and/or the tracer into the fluid.

The carrier may be selected to controllable degrade on contact with a fluid. The carrier may be selected to degrade by hydrolysis of the carrier.

The tracer material and/or the carrier may be fluid specific such that the tracer molecules will be released from the tracer material as a response to a contact with a target liquid.

The tracer material and/or the carrier may be chemically intelligent such that tracer molecules will be released from the tracer material as a response of specific events, e.g. they respond to an oil flow (oil-active) but show no response to a water flow (water-resistant). Another group of chemical compounds can be placed in the same region, which release tracers in water flow (water-active) but show no response to an oil flow (oil-resistant). The tracers and/or the carrier may be chemically intelligent such that tracer molecules will be released from the tracer material as a response the exposure of the tracer material to a well fluid and/or a target well fluid.

The tracer may be detected, and its concentration measured by different techniques such as optical detection, optical fibers, spectrophotometric methods, PCR techniques combined with sequential analysis, chromatographic methods or radioactivity analysis. The invention is not restricted to the above-mentioned techniques.

The tracer may be detected and its concentration measured by sampling production fluid. The sampling may be achieved by a sampling probe arranged in the production flow. The sampling probe may be located downhole or at surface. The sampling may be conducted at the one or more of said sampling times. The sampling may be conducted downhole downstream of the tracer release apparatus or at surface. Samples may be collected for later analysis.

The tracer may be detected by a detection device such a sensor. The detection device may facilitate real time monitoring and/or analysis of the tracer in the production fluid. The real time monitoring and/or analysis may be achieved by a detector probe. The detector probe may be arranged in the production flow. The detector probe may be located downhole or at surface.

The tracer material may be disposed in the tracer chamber to allow fluid to contact the tracer material as it passes around the tracer material in the tracer chamber.

The at least one valve may be an electrically actuated valve, a mechanical valve and/or thermodynamic valve. The at least one valve may be configured to selectively open and/or close in response to a well event.

The at least one valve may be configured to selectively open and/or close in response to a change in temperature, pressure and/or velocity The at least one valve may be configured to selectively open and/or close in response to at least one electronic signal.

The at least one valve may be a differential pressure operated valve. The at least one valve may be configured to selectively open and/or close in response to a pressure differential across the valve.

The at least one valve may be configured to selectively open and/or close in response to changes in fluid pressure in the well. The at least one valve may be configured to selectively open and/or close in response to a pressure differential between the at least one inlet and the at least one outlet. The at least one valve may be configured to selectively open and/or close in response to a pressure differential between the tracer release apparatus and the production tubing. The at least one valve may be configured to selectively open and/or close in response to a pressure differential between the fluid volume and the production tubing.

The at least one valve may be a velocity valve. The at least one valve may be configured to selectively open and/or close in response to changes in fluid velocity in the production flow.

The at least one valve may be an electrically actuated valve. The at least one valve may be configured to selectively open and/or close in response to receiving at least one electric or electronic signal. The at least one valve may be wired or wirelessly controlled. The signal to control the actuation of the valve may be from the surface or from some other external source. The at least one valve may comprise or be connected to a wireless communication system. The wireless communications system may comprise at least one wireless receiver capable of wirelessly receiving data to control and operate the electrically actuated valve. The wireless communications system may comprise at least one transmitter to transmit a signal.

The at least one valve may be configured to selectively open and/or close in response to inducing a transient in the production rate of the production flow. The transient may be a temporary transient in the production rate of the production flow.

The at least one valve may be set to be normally open or normally closed. The at least one valve may be a flapper valve or a sleeve valve. The at least one valve may be adjustably set to be normally open or normally closed. Preferably the at least one valve is configured to react to the fluid velocity or fluid pressure in the well.

The at least one valve may be set to open and/or close at a predetermined fluid velocity or fluid pressure rate of flow. The valve may be configured to have at least one actuation threshold level.

The at least one valve may be set to partially open and/or partially close the valve. The valve may be configured to open and/or close the valve at intermediate positions between fully open and fully closed.

The at least one valve may be configured to open and close to intermediate positions between the fully open and fully closed position to selectively control the flow of fluid through the at least one outlet.

The at least one valve may comprise a biasing mechanism. The at least one valve may be balanced or biased by a biasing mechanism which is configured to set the valve with a pre-determined fluid velocity or fluid pressure level which must be reached before the valve is actuated. The biasing mechanism may be a spring. The biasing mechanism may be a coil spring, a wave spring or a gas spring such as a nitrogen gas spring.

The biasing mechanism may be adjusted to set the actuation threshold of the valve. Preferably the valve is a biased by a spring which may be adjustable by changing the type, length or tension of the spring. The actuation threshold of the valve may be set.

The at least one tracer release apparatus may be retrofitted into an existing tubing. The at least one tracer release apparatus may be retrievable, installed, replaced and/or adjusted by wireline, slickline, coiled tubing, drill pipe or similar conveyance.

The at least one tracer release apparatus may be installed or replaced and may be conveyed through the production tubing by wireline, slickline, coiled tubing, drill pipe or similar conveyance. The at least one tracer release apparatus may be conveyed onto at least one landing nipple. The at least one landing nipple may have ports in communication with the production tubing and/or the annulus.

The at least one tracer release apparatus or a component of the at least one tracer release apparatus may be installed or replaced and may be conveyed through the production tubing by wireline, slickline, coiled tubing, drill pipe or similar conveyance.

The at least one valve may be retrofitted into an existing tracer release apparatus located downhole. The at least one valve may be retrievable, installed, replaced and/or adjusted by wireline, slickline, coiled tubing, drill pipe or similar conveyance.

The at least one valve may be installed or replaced and may be conveyed through the production tubing by wireline, slickline, coiled tubing, drill pipe or similar conveyance. The at least one valve may be conveyed onto at least one landing nipple. The at least one landing nipple may have ports in communication with the production tubing and/or the annulus.

The valve settings of the at least one valve may be adjusted via direct connection from surface to the valve. The valve settings may be adjusted via an intervention operation by lowering an intervention device by wireline, slickline, coiled tubing, drill pipe or similar conveyance to manipulate and adjust the setting on the at least one valve.

The tracer release apparatus may comprise at least one flow restriction device. The at least one flow restriction device may be located in the tracer chamber. The least one flow restriction device may be located in the at least one inlet and/or in the at least one outlet.

The at least one flow restriction device may be selected from the group consisting of a nozzle, orifice, venturis, pitot tubes or a deviated pathway.

The at least one flow restriction device may be configured to control the release of the tracer molecules from the tracer chamber of the tracer release apparatus into the production tubing. The at least one flow restriction device may be adjustable to change the release rate of the tracer molecules from the tracer chamber.

The at least one flow restrictor device may be adjusted to change the release of the tracer and to adjust the amplitude and/or duration of the tracer response spike at the detection point. The release of the tracer from the tracer release apparatus to the production tubing can be delayed or prolonged by providing a flow restriction device. Increasing the resistance of the flow restriction device to the fluid flow through it results in an increase in time to flush-out the tracer.

Tracer release from the tracer release apparatus may create a characteristic signal called flush-out signal. The flush-out signal has a peak concentration followed by the decay of the concentration. The decay of the concentration after the peak may be expressed by a slowly decaying function such as exponential function or power law function. The coefficient in the functions describing the steepness of the decay is proportional to the fluid velocity inside the tracer release apparatus and thus the fluid velocity inside the tracer release apparatus can be calculated based on the measured tracer concentration decay curve. Steeper curve, i.e., shorter flush-out time, corresponds to the higher fluid velocity inside the tracer release apparatus.

The duration of the tracer signal may be captured by sampling or real time measurement. The signal should be long enough that it is not destroyed by the dispersion during the travel to the detection point which may be located after the upper completion and a long tie-back. Tracer release and dispersion may be modelled by flow models. The dispersion of the signal during the travel to the detection point may be compensated by modelling. based on the well geometry and/or a model of the well.

The tracer release apparatus may comprise at least one inlet valve. The at least one inlet may control the flow of fluid through the at least one inlet. The tracer release apparatus may comprise an outlet valve to control the flow of fluid through the at least one outlet. The at least one inlet and/or outlet may be configured to control the release of the tracer molecules from the tracer chamber of the tracer release apparatus into the production tubing. The at least one inlet and/or outlet may act as a restriction device and may be adjustable to change the release rate of the tracer molecules from the tracer chamber.

The at least one inlet valve and the at least one outlet valve may be configured to act independently of one another. The at least one inlet valve and the at least one outlet valve may be configured to act in co-operation with one another. The at least one inlet valve and the at least one outlet valve may be configured such that one valve acts as a master valve and the other valve acts as a slave valve, such that the slave valve mimics the actions and responses of the master valve.

The at least one inlet and/or the at least one outlet may be in fluid communication with the production tubing. The at least one inlet and/or the at least one outlet may be in fluid communication with the annulus. The production tubing may be an inner pipe into which production fluid enters in the production zone. The production tubing may extend from downhole to surface.

The tracer release system may comprise two or more tracer release apparatus. The two or more tracer release apparatus may be configured for connection to a production tubing at different positions along the production tubing. The tracer release apparatus may be positioned downstream of an influx zone. Each tracer chamber of the respective tracer release apparatus may comprise a distinct tracer material.

Embodiments of the fifth aspect of the invention may include any of features of the first to fourth aspects of the invention or their embodiments, or vice versa.

According to a sixth aspect of the invention, there is provided a method of releasing a tracer into a production flow comprising providing at least one tracer release apparatus connected to production tubing, the at least one tracer release apparatus comprising;

at least one outlet in fluid;

at least one tracer chamber in fluid communication with the at least one outlet;

a tracer material located in the tracer chamber;

at least one valve configured to selectively control the flow of fluid through the at least one outlet; and opening the at least one valve and releasing tracer from the flow passage and through the at least one outlet.

The at least one outlet may be in fluid communication with the production flow. The at least one tracer release apparatus may comprise at least one inlet in fluid communication with the production flow. The at least one tracer chamber in fluid communication with the at least one inlet. The at least one valve configured to selectively control the flow of fluid through the at least one inlet.

The method may comprise opening and/or closing the at least one valve in response to changes in fluid velocity or fluid pressure in the well. The method may comprise opening and/or closing the valve in response to a pressure differential between the at least one inlet and the at least one outlet. The method may comprise opening and/or closing the valve in response to a pressure differential between the tracer chamber and the production tubing.

The method may comprise creating a pressure differential between the at least one inlet and the at least one outlet. The pressure differential may be created by adjusting the flow rate of the production flow.

The method may comprise adjustably setting at least one threshold fluid flow rate or pressure level to actuate the valve to selectively open and/or close the at least one outlet.

The method may comprise opening the at least one valve to an intermediate position between the fully open and fully closed positions.

The method may comprise closing the at least one valve for a period of time to shut in the tracer chamber and increase the concentration of tracer particles or molecules released into the flow passage and/or fluid volume. The at least one valve may be closed for less than 24 hours to shut in the tracer chamber. The valve may be closed for more than 24 hours to shut in the tracer chamber. By high or increased concentration it is referred to as an elevated concentration of tracer molecules when compared to the concentration of the tracer molecules present in well fluid which has not been shut in the tracer release apparatus.

The method may comprise opening the valve to release fluid and tracer molecules from the tracer chamber through the at least one outlet into the production flow.

The method may comprise releasing the tracer molecules from the tracer chamber by flushing the flow passage with production fluid entering the flow passage The method may comprise adjusting the flow rate of the production flow to adjust the fluid flow velocity acting on the at least one valve. The method may comprise increasing the flow rate of the production flow to creating a pressure differential between the at least one inlet and the at least one outlet to close or open the at least one valve.

The method may comprise decreasing the flow rate of the production flow to creating a pressure differential between the at least one inlet and the at least one outlet to close or open the valve.

The method may comprise restricting flow from the tracer chamber to the production tubing. The method may comprise restricting flow though the tracer chamber to control and/or delay the release of fluid from the tracer chamber into the production tubing.

The method may comprise releasing the tracer at a concentration such that it is detectable downstream by sampling and/or real time methods.

Embodiments of the sixth aspect of the invention may include any of features of the first to fifth aspects of the invention or their embodiments, or vice versa.

According to a seventh aspect of the invention, there is provided a method of estimating an influx profile for at least one of the well fluids to a producing well with two or more influx zones to a production flow comprising arranging two or more tracer release apparatus connected to the production tubing at known levels of the well, wherein each tracer release apparatus comprises at least one outlet at least one tracer chamber in fluid communication with the at least one outlet a distinct tracer material located in the at least one tracer chamber; and at least one valve configured to selectively control the flow of fluid through the at least one outlet;

opening the at least one valve to release tracer molecules from the tracer chamber into the production flow though the at least one outlet;

measuring the concentration of tracer and estimating an influx profile for at least one of the well fluids based on the type of tracer and the measured tracer concentrations.

The at least one outlet may be in fluid communication with the production flow. The at least one tracer release apparatus may comprise at least one inlet in fluid communication with the production flow. The at least one tracer chamber in fluid communication with the at least one inlet. The at least one valve configured to selectively control the flow of fluid through the at least one inlet.

The well fluids may be oil, water and/or gas. Each tracer release apparatus may be connected to the production tubing at a different influx zone location. By providing tracer release apparatuses at influx zones the contribution of each individual zone to total well production may be monitored, estimated and/or calculated.

The method may comprise analysing characteristics of the tracer release, sampling time, and/or cumulative produced volume of the influx volumes from different influx zones.

The method may comprise closing the valve on at least one tracer release apparatus for a period of time to shut in the tracer release apparatus. By shutting in the tracer release apparatus the concentration of tracer particles or molecules released into the flow passage increases until the volume of fluid in the flow passage becomes saturated with tracer particles.

The method may comprise closing the at least one valve for a period of time sufficient to build up a high concentration of tracer molecules that may be detectable as a high amplitude tracer response signal at the detection point downstream when the tracer particles or molecules are released from the tracer release apparatus.

The method may comprise shutting in the tracer release apparatus for a period of time. The period of time may range from hours to months.

The method may comprise closing the valve for less than 24 hours to shut in the tracer release apparatus. The method may comprise closing the valve for more than 24 hours to shut in the tracer release apparatus. The method may comprise closing the valve to restrict access or exposure to the tracer material by the production flow.

The method may comprise opening the valve to release fluid and tracer particles or molecules from the flow passage or fluid volume of the tracer release apparatus through the outlet into the production flow.

The method may comprise opening the valve by adjusting the fluid velocity and/or fluid pressure in the production tubing. The method may comprise closing the valve by adjusting the fluid velocity and/or fluid pressure in the production tubing.

The method may comprise opening the valve in response to a pressure differential between the at least one inlet and the at least one outlet. The method may comprise opening and/or closing the valve in response to a pressure differential between the flow passage and the production tubing.

The pressure differential may be created by adjusting the flow rate of the production flow.

The method may comprise opening the valves on each of the two or more tracer release apparatus at substantially the same time to release tracer molecules into the production flow.

The method may comprise adjustably setting the valve to actuate above or below a predetermined production flow rate threshold or range. The method may comprise adjustably setting the valve to actuate at multiple predetermined production flow rate thresholds or ranges.

The method may comprise releasing the tracer particles or molecules from the flow passage of each tracer release apparatus by production fluid entering the flow passage and flushing the tracer molecules from the flow passage.

The method may comprise adjusting the flow rate of the production flow to create a pressure differential to close the valve after the tracer molecules have been flushed from the tracer release apparatus.

The method may comprise controlling and/or delaying the release of fluid from the tracer release apparatus into the production tubing by restricting flow from the tracer release apparatus to the production tubing.

The method may comprise taking samples of well fluid downstream of the tracer release apparatus. The samples may be taken at surface.

Samples of the well fluid are taken at the surface, and concentration of the tracer in the well fluid are measured. Samples may be collected and/or measured downstream at known sampling times. Based on the measured concentrations and their sampling sequence and the well geometry the influx volumes may be calculated. The method may comprise estimating or calculating an influx profile based on the concentration and type of tracer as a function of the sampling time. The influx volumes may be calculated from transient flow models. The influx volumes may be used to estimate the influx profile of the well.

The method may comprise creating at least one detectable tracer spike at a detection point downstream of the tracer release apparatus.

The method may comprise analysing characteristics of the tracer release, sampling time, and/or cumulative produced volume of the influx volumes from different influx zones. The method may comprise analysing the arrival of the concentration peaks of each tracer to determine the percent of inflow that occurs between tracer locations. The method may comprise analysing the rate of decline of the tracer concentration from each tracer location and/or tracer release apparatus location to determine the percent of reservoir inflow from each influx zone.

The method may comprise using the calculated influx profile as parameters for controlling the production flow or for characterising the reservoir. The method may comprise modelling the influx rates in a model well. The modelled influx profile and/or rates may be adjusted until the calculated concentrations of model tracers compare with the measured concentrations of identified tracers to estimate an influx profile.

Embodiments of the seventh aspect of the invention may include any of features of the first to sixth aspects of the invention or their embodiments, or vice versa.

According to an eighth aspect of the invention, there is provided a method of monitoring influx of a fluid to a hydrocarbon producing well, the method comprising:

providing at least one tracer release apparatus in a hydrocarbon producing well at an influx location; wherein the at least one tracer release apparatus comprises:

a fluid volume; and a tracer material located in the fluid volume;

shutting in the tracer release apparatus to build a high concentration of tracer molecules in the fluid volume;

releasing the high concentration of tracer molecules from the tracer release apparatus into the production flow; and detecting the presence of tracer downstream of the influx location.

The method may comprise shutting in the tracer release apparatus during production in the well. The method may comprise shutting in the tracer release apparatus to limit or restrict the exposure of the tracer material to the production flow. The method may comprise shutting in the tracer release apparatus at a first production flow rate. The method may comprise releasing the high concentration of tracer molecules from the tracer release apparatus at a second production flow rate.

The at least one tracer release apparatus may comprise at least one controllable valve. The at least one controllable valve may be configured to shut in the tracer release apparatus to allow the concentration of tracer molecules in a fluid volume in the tracer chamber to increase or accumulate. This may allow the build up tracer molecules locally in the fluid in the tracer chamber forming a tracer cloud that may be flushed out when the valve is opened.

The at least one controllable valve may be configured to control the flow of fluid through an outlet of the at least one tracer release apparatus. The method may comprise modifying the production flow rate in the production tubing to actuate the at least one controllable valve to shut in the tracer release apparatus and/or to release the high concentration of tracer molecules from the tracer release apparatus.

The method may comprise collecting samples of the production flow wherein the sampling is conducted at the one or more sampling times.

The method may comprise monitoring influx of a fluid to a hydrocarbon producing well in real time. The method may comprise conducting optical monitoring for detection of the tracers in the production flow.

The method may comprise analysing the arrival of concentration peaks of each tracer to determine the percent of inflow that occurs between tracer locations.

The method may comprise analysing a rate of decline of the tracer concentration from each tracer location to determine the percent of reservoir inflow from each influx zone.

The method may comprise modifying the production flow rate in the production tubing to shut in the tracer release apparatus and/or to release the high concentration of tracer molecules from the tracer release apparatus.

The method may comprise temporarily modifying a production flow rate to a higher or lower production flow rate to shut in the tracer release apparatus and/or to release the high concentration of tracer molecules from the tracer release apparatus.

The method may comprise detecting the tracer by techniques selected from the group comprising optical detection, optical fibers, spectrophotometric methods, PCR techniques combined with sequential analysis, chromatographic methods and/or radioactivity analysis. The method may comprise optically detecting the tracer.

Embodiments of the eighth aspect of the invention may include any of features of the first to seventh aspects of the invention or their embodiments, or vice versa.

According to a ninth aspect of the invention there is provided a method of releasing a tracer into a production flow of a hydrocarbon producing well, the method comprising:

providing at least one tracer release apparatus connected to a production tubing in a hydrocarbon producing well at an influx location;

the tracer release apparatus comprising:

a fluid volume; a tracer material located in the fluid volume; an outlet to the fluid volume; and a controllable valve configured to selectively control the flow of fluid through the at least one outlet;

inducing a transient in the production flow to release at least one tracer from the at least one tracer release apparatus into the production tubing.

The method may comprise inducing a transient to actuate the controllable valve to release at least one tracer from the at least one tracer release apparatus into the production tubing. The method may comprise modifying the production flow rate to induce a transient in the production flow.

Embodiments of the ninth aspect of the invention may include one or more of any of features of the first to eighth aspects of the invention or their embodiments, or vice versa.

According to a tenth aspect of the invention there is provided a method of collecting samples for analysis in estimating an influx profile of a hydrocarbon producing well, the method comprising;

providing at least one tracer release apparatus connected to a production tubing in a hydrocarbon producing well at an influx location;

the tracer release apparatus comprising:

a fluid volume; a tracer material located in the fluid volume; an outlet to the fluid volume;

and a controllable valve configured to selectively control the flow of fluid through the at least one outlet;

inducing a transient in the production flow to release at least one tracer from the at least one tracer release apparatus; and collecting samples at a location downstream of the tracer sources after inducing the transient in the production flow.

The method may comprise inducing a transient to actuate the controllable valve to release at least one tracer from the at least one tracer release apparatus into the production tubing.

Embodiments of the tenth aspect of the invention may include one or more of any of features of the first to ninth aspects of the invention or their embodiments, or vice versa.

According to an eleventh aspect of the invention there is provided a method of detecting at least one tracer in a production flow comprising;

providing at least one tracer release apparatus connected to a production tubing in a hydrocarbon producing well at an influx location;

the tracer release apparatus comprising:

a fluid volume; a tracer material located in the fluid volume; an outlet to the fluid volume;

and a controllable valve configured to selectively control the flow of fluid through the at least one outlet;

inducing a transient in the production flow to release at least one tracer from the at least one tracer release apparatus; and conducting real time measurements of the concentration of tracer in the production flow.

Embodiments of the eleventh aspect of the invention may include one or more of any of features of the first to tenth aspects of the invention or their embodiments, or vice versa.

According to a twelfth aspect of the invention there is provided a method of estimating an influx profile for at least one of the well fluids to a producing well with at least one influx zones to a production flow comprising;

arranging at least one tracer release apparatus connected to the production tubing at known levels of the well;

wherein the tracer release apparatus comprises;

a fluid volume and tracer material located in the fluid volume; at least one outlet to the fluid volume; and at least one controllable valve configured to selectively control the flow of fluid through the at least one outlet;

inducing a transient in the production flow to release at least one tracer from the at least one tracer release apparatus;

measuring the concentration of tracer in the production flow;

and estimating an influx profile for at least one of the well fluids based on the type of tracer and the measured tracer concentrations.

Embodiments of the twelfth aspect of the invention may include one or more of any of features of the first to eleventh aspects of the invention or their embodiments, or vice versa.

According to a thirteenth aspect of the invention, there is provided a system for monitoring influx of a fluid to a hydrocarbon producing well, the system comprising:

at least one probe; and at least one tracer release apparatus for connection to a production tubing, the at least one tracer release apparatus comprising at least one outlet;

at least one tracer chamber in fluid communication with the at least one outlet;

a tracer material located in the tracer chamber; and at least one valve configured to selectively control the flow of fluid through the at least one outlet.

The at least one probe may be arranged in the production flow in the production tubing. The at least one probe may be located downhole or at surface. The at least one probe may be a sample collection probe, a detector probe and/or a real time detector probe.

Embodiments of the thirteenth aspect of the invention may include one or more of any of features of the first to twelfth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
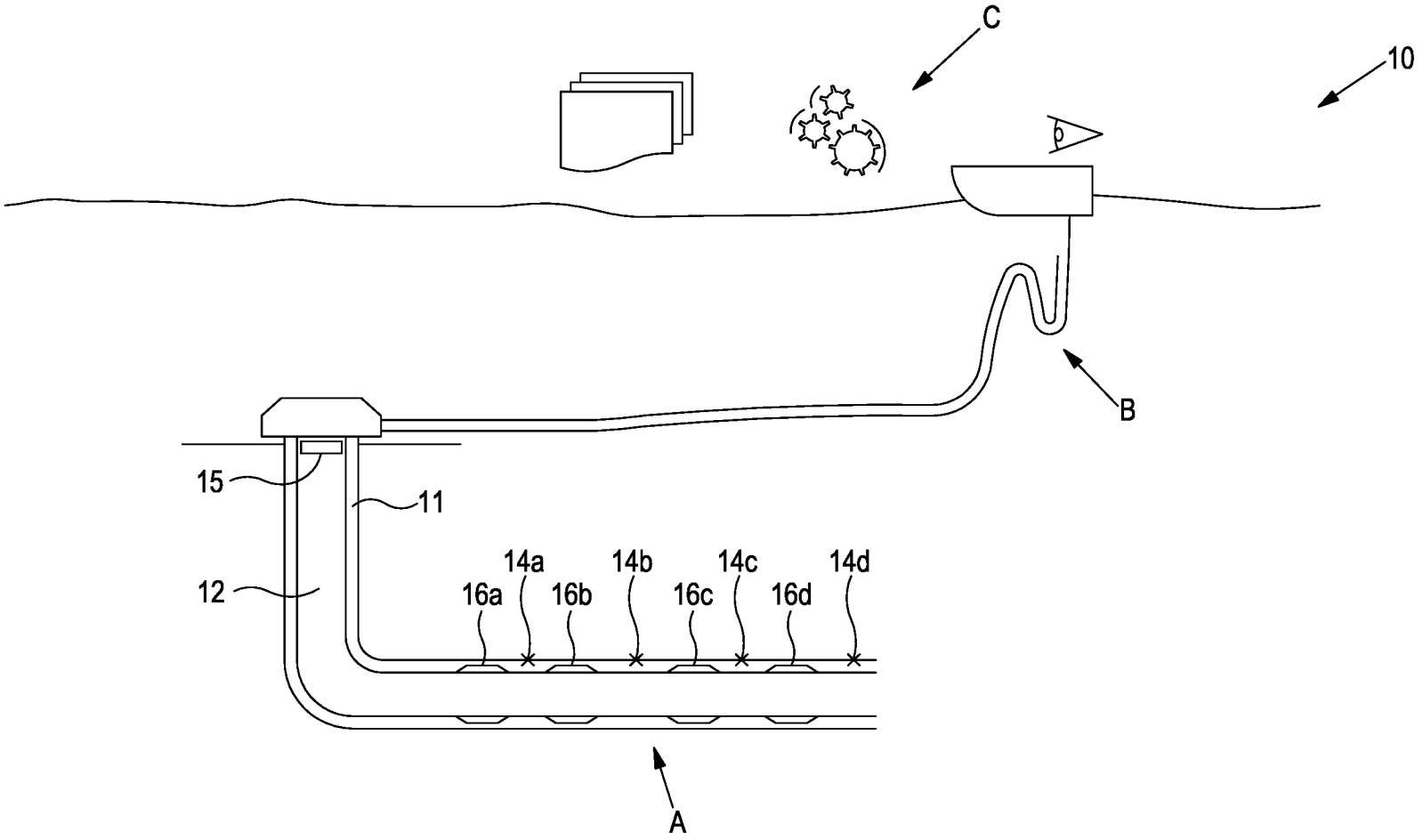
FIG. 1 is a simplified sectional diagram through a production well with a tracer release system installed in accordance with an aspect of the invention.

FIG. 1 is a simplified section through a production well 10. A central production tubing 12 is arranged in the well surrounded by annulus 11. Influx volumes of fluids enter the well from a reservoir into the central production tubing 12 via separate influx locations. Tracers release apparatus 16 are installed in or on the production tubing and are arranged near each influx location. Tracers are released and measured at surface to provide information on which influx locations are producing and the rates of influx. In this example, there are four influx locations 14*a*, 14*b*, 14*c* and 14*d* and four tracer release apparatus 16*a*, 16*b*, 16*c* and 16*d* each with a tracer source with distinct tracer material distinct for each influx location. However, there may be a different number of influx zones and/or tracer release apparatus than illustrated in FIG. 1. An adjustable choke assembly 15 is arranged to control the production flow rate. In FIG. 1 the adjustable choke assembly 15 is connected to the production tubing to control the fluid flow rate or downstream system pressure in the production tubing. However, it will be appreciated that the choke may be located at different positions in the well.

FIG. 1 shows a general overview of the monitoring principle with the indicated steps of A) Controllable release of tracers in several locations along the well; B) Flow to top-side and detection of tracer; C) Monitoring tracer signal received and interpretation of data to derive zonal inflow along the well of at least one well fluid.

Arrows in the examples below denote the direction of fluid travel and are indicative of flow velocity (for example two arrows indicates a high flow rate than one arrow and vice versa).

Figure 2A:
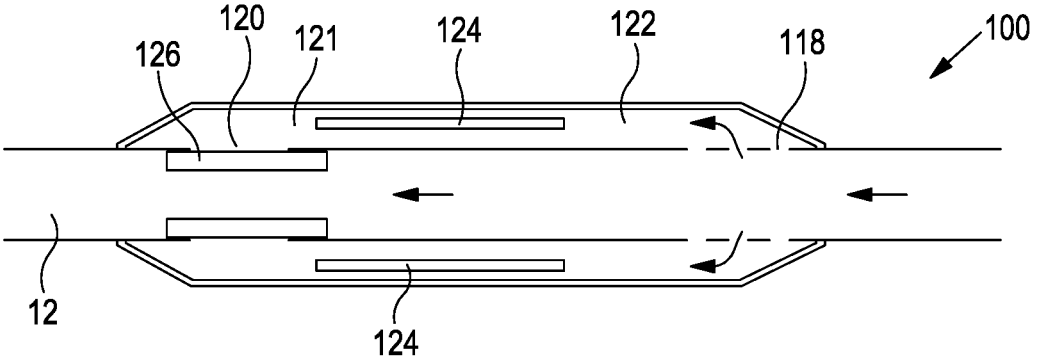
FIGS. 2A to 2C are enlarged sectional views of a tracer release apparatus of the tracer release system of FIG. 1 showing operation steps for a long tracer release apparatus shut in in a well with a normally low production rate.
Figure 2B:
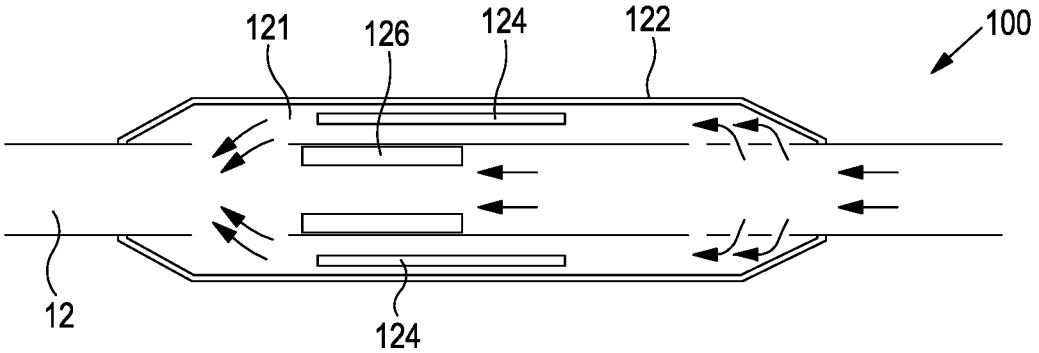
Figure 2C:
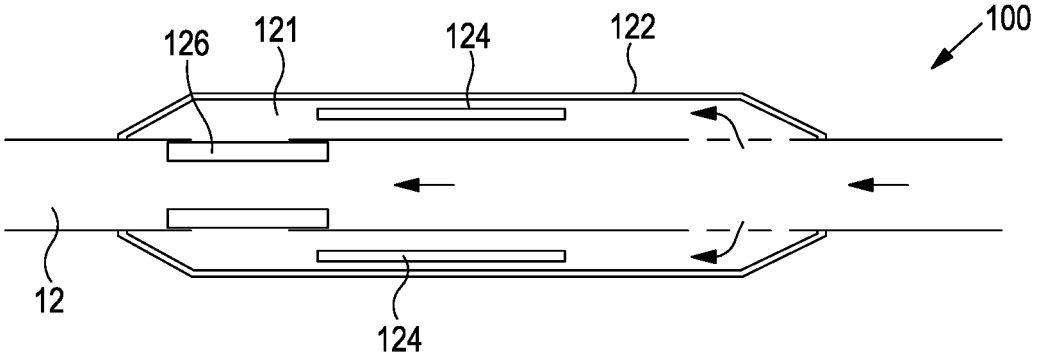

FIGS. 2A to 2C are enlarged sections of a tracer release apparatus 100. The apparatus is installed on or in a production tubing 12. The tracer release apparatus has an inlet 118 and an outlet 120 in fluid communication with a production pipe 12. The apparatus 100 has an annulus chamber 121 surrounding the production tubing with a flow passage 122 which comprises a tracer material 124. The tracer material may be disposed in the flow passage to allow fluid to contact the tracer material and pass around the tracer material in the passage 122. The tracer material 124 is designed to release tracer molecules or particles when exposed to a target well fluid i.e. oil, gas or water.

A valve assembly 126 is fixed with a movably closure member 125 for selectively opening and closing the outlet aperture 120*a* to control the flow of fluid from the flow passage 122 to the production pipe.

In the examples show in FIGS. 2A to 2C, the valve assembly is a velocity valve mounted in the inner diameter of the production pipe. The velocity valve has a moveable sleeve member 125. However, it will be appreciated that the valve assembly may be mounted in the inner volume of the tracer release apparatus.

The valve assembly 126 is a velocity valve designed to open and close the sleeve member 125 in response to changes in production flow rate. In this case the change in production flow is controlled by adjusting the choke assembly 15. The valve assembly is set to open above a pre-set production flow rate threshold and close below the set threshold.

During normal low production flow rate the flow rate is below the pre-set production flow rate threshold and therefore the valve 126 remains closed.

Tracer material 124 in the flow passage remains exposed to a volume of fluid in the flow passage 122 over the period of time that the valve 126 is closed, building up a high or increased concentration of the tracer molecules 124*a* in the fluid volume of the tracer release apparatus.

When a tracer analysis operation is required, the choke assembly is temporarily adjusted to increase the production flow rate to a second flow velocity which it higher than the pre-set threshold for the valve 126, the valve 126 opens the outlet 120 releasing the fluid with high or increased concentration tracer molecules as a tracer cloud into the production tubing 12. The tracer cloud is carried to surface by the production fluid. The tracer cloud creates a high amplitude spike signal at a detection point and the concentration of tracer determined. At surface the tracer may be detected by a probe assembly discussed further in FIGS. 17A to 19.

To shut in the tracer release apparatus the choke assembly is adjusted to reduce the production flow to a flow velocity which is lower than the pre-set threshold for the valve assembly, the valve assembly is actuated to move the sleeve to close the outlet 120 shutting in the flow passage and allowing the tracer concentration to build up.

By exposing tracer to production flow only when a tracer cloud is to formed and released the lifespan of the tracer may be extended. The small volume of fluid in the flow passage may quickly become enriched with tracer molecules. As the small volume of fluid becomes enriched the tracer molecule release rate from the tracer material may be reduced.

This may allow a wide range of tracers to be used including fast release tracer polymer systems. By providing fast release tracer polymer systems into the tracer release apparatus it avoids significant time lags between tracer analysis operations. This contrasts with the standard practice of extending tracer lifespan by reducing tracer release rate so that it lasts as long as possible downhole.

Figure 3A:
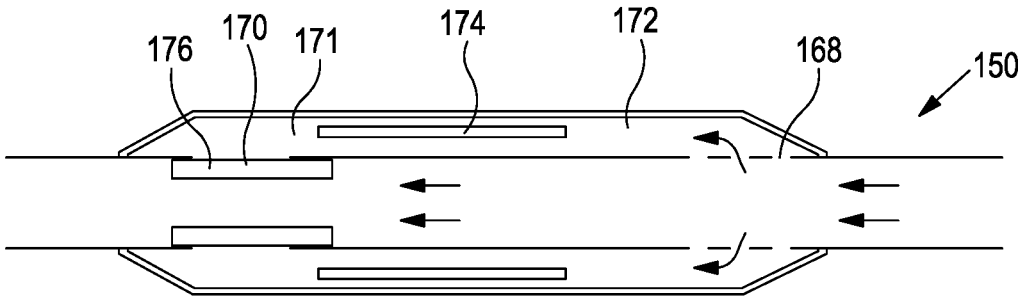
FIGS. 3A to 3C are enlarged sectional views of a tracer release apparatus of the tracer release system of FIG. 1 showing operation steps for a long tracer release apparatus shut in in a well with a normally high production rate.
Figure 3B:
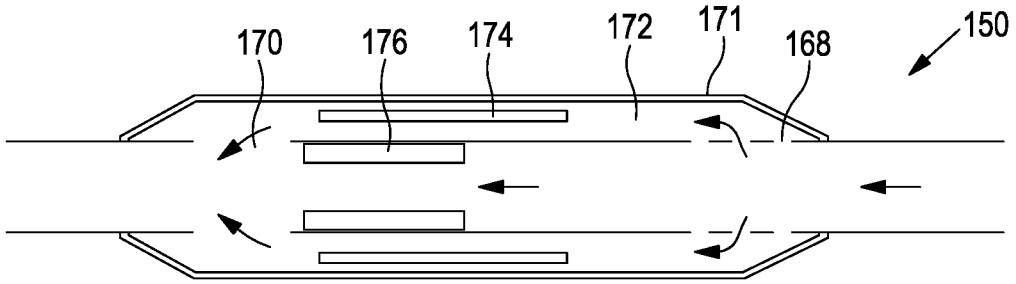
Figure 3C:
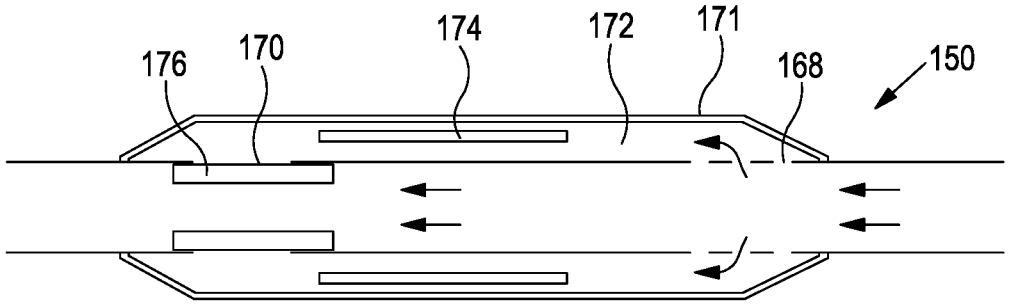

FIG. 3A to 3C describes an inverse valve assembly arrangement for high production rate to FIGS. 2A to 2C. In FIGS. 3A to 3B the tracer release apparatus 150 has a valve assembly 176 configured to open the outlet 170 below a pre-set production flow rate threshold and close the outlet 170 above the threshold rate.

During normal high flow rate production as shown in FIG. 3A, the production flow rate is above the pre-set production flow rate threshold and therefore the valve 176 remains closed. Tracer material 174 in the flow passage remains exposed to a volume of fluid and a high concentration of the tracer molecules in the fluid volume builds up.

To actuate the valve 176 to open the outlet 170 a choke assembly is temporality adjusted to reduce the production flow to a flow velocity which is lower than the pre-set threshold for the valve 176, the valve assembly opens releasing the accumulated increased concentration of tracer molecules as a tracer cloud into the production flow as shown in FIG. 3B. The tracer clouds travel to surface in the production flow and create detectable high amplitude tracer response spike signal at the detection point.

When the choke assembly (not shown) is adjusted to back to the normal production flow rate which is above the valve threshold level, the valve 176 is actuated to close the outlet 170 as shown in FIG. 3C.

Figure 4A:
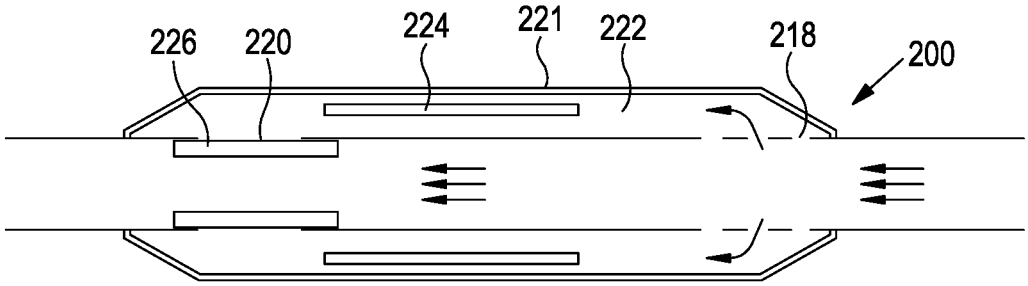
FIGS. 4A to 4C are enlarged sectional views of a tracer release apparatus of the tracer release system of FIG. 1 showing operation steps in shutting the tracer release apparatus at two valve thresholds.
Figure 4B:
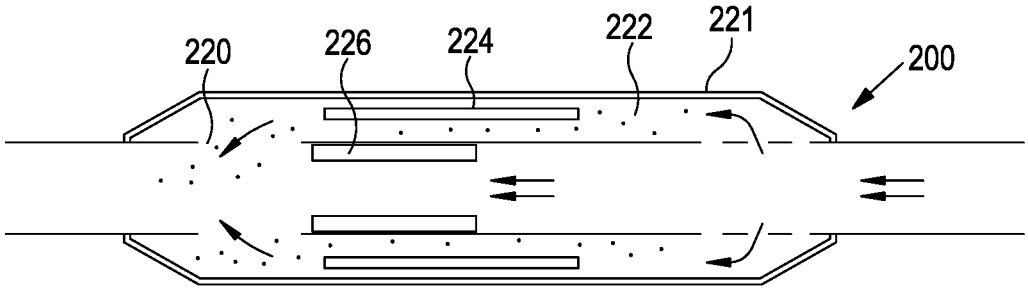
Figure 4C:
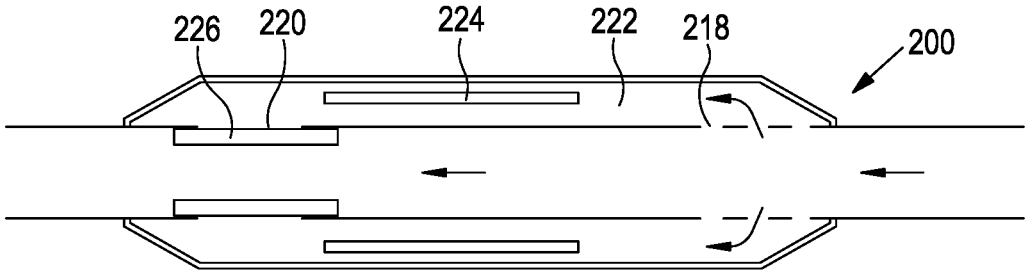

FIGS. 4A to 4C shows an alternative arrangement of the tracer release apparatus of FIG. 2A and will be understood from the description of FIGS. 2A to 2C above.

However, the tracer release apparatus 200 has a differential pressure valve 226 with two adjustable actuation threshold levels to actuate the valve 226 to close the outlet 220. The valve is set so that it closes the outlet 220 above a first pre-set production flow rate threshold and below a second pre-set production flow rate threshold. The valve 226 is therefore configured to open over a flow rate range between the two threshold levels.

During normal high production the flow rate as shown in FIG. 4A, the flow rate is above the first pre-set production flow rate threshold and therefore the valve 226 is actuated to close the outlet 220. However, adjusting the production choke to reduce the production rate below the pre-set production flow rate threshold actuates the valve to open the outlet and allows the tracer cloud to be released as shown in FIG. 4B.

Further adjusting the choke to reduce the production rate below the second pre-set production flow rate threshold actuates the valve to closes the outlet. This means that should the well be shut in the valve closes the outlet and limits the volume of fluid the tracer material contacts thereby extending the lifespan of the tracer.

FIGS. 5A to 5D show stages of the operation two tracer release apparatus to release tracer into the production flow. In wells with more than one tracer release apparatus the valve assemblies for each tracer release apparatus may be arranged to release the tracer cloud simultaneously. FIGS. 5A to 5D show stages of the operation of valve assemblies for synchronised release of tracer from two tracer release apparatus in a well.

FIG. 5A to 5D describes a tracer release system 250 having two tracer release apparatus 266*a* and 266*b* each having a valve assembly 276*a*, 276*b* respectively configured to open an outlet in the tracer release apparatus above a pre-set production flow rate threshold and close below the threshold. The valves 276*a* and 276*b* are closed during normal low production and open in temporary high production.

Figure 5A:
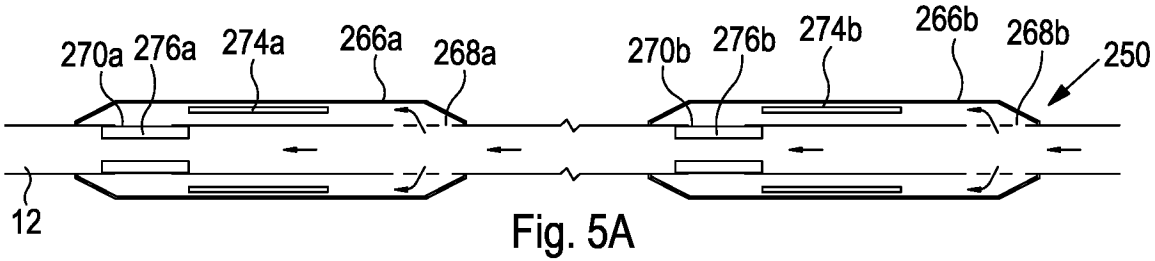
FIGS. 5A to 5D are enlarged sectional views of two tracer release apparatus of the tracer release system of FIG. 1 showing operation steps for a long tracer release apparatus shut in in a well with a normally low production rate.

The valve 276*a* and 276*b* of tracer release apparatus 266*a* and 266*b* are configured to open above a pre-set production flow rate threshold and close below the threshold level. During normal low production the flow rate is below the pre-set production flow rate threshold and therefore the valve assemblies 276*a* and 276*b* remain closed as shown in FIG. 5A. Fluid passes from the production pipe through inlets 268*a* and 268*b* into the flow passage 472. The tracer material is exposed to the fluid and tracer molecules are released into the fluid.

Figure 5B:
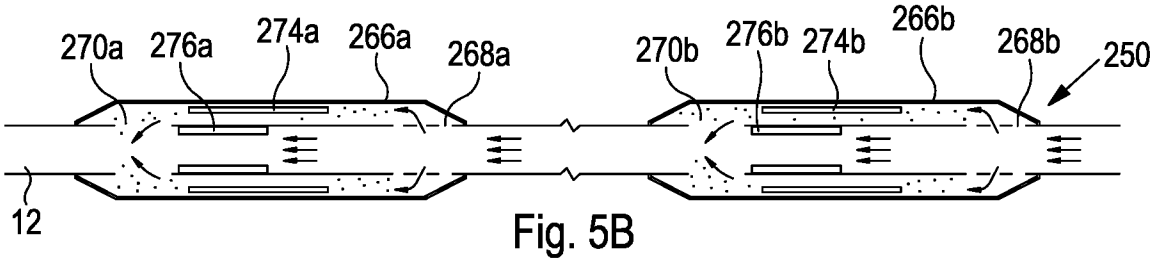

To release the tracer a production pipe choke assembly is adjusted to increase the production flow to a second flow rate which it significantly higher than the pre-set threshold for the valve assemblies 276*a* and 276*b*. As a result, valve assemblies 276*a* and 276*b* open simultaneously allowing the tracer clouds from tracer release apparatus 266*a*, 266*b* to be released simultaneously as shown in FIG. 5B.

Figure 5C:
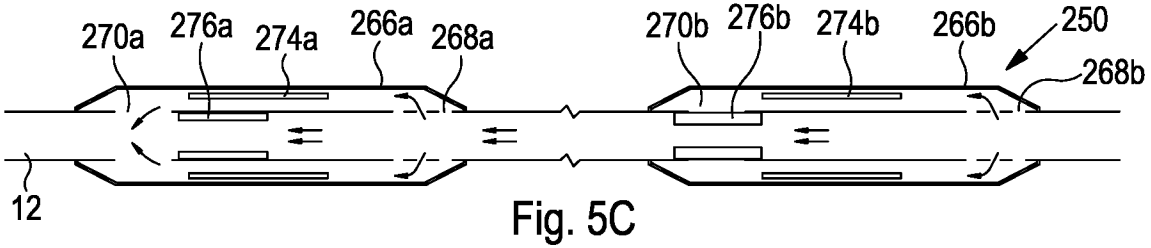

To shut in the tracer release apparatus the choke assembly is adjusted to decrease the production flow to a third flow rate. The third flow rate is higher than the first rate and lower than the second flow rate. At the third flow rate the valve assembly 276*b* closes as shown in FIG. 5C. However, as the two different tracer release apparatus are at different locations in the well, they are subject to variations in localised pressure and therefore the pressure differential required to close the valve assemblies is not the same. As a result, valve assembly 276*b* closes whilst valve assembly 276*a* remains open.

Figure 5D:
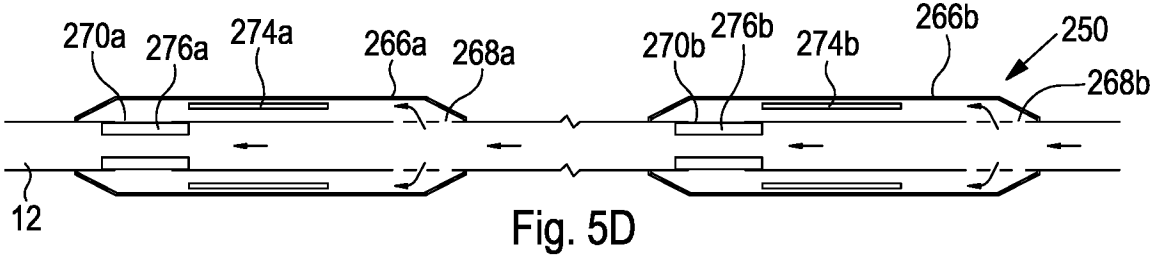

The choke assembly is adjusted to reduce the production flow back to the first flow rate. At the first flow rate the valve assembly 276*a* returned to the closed condition as shown in FIG. 5D.

FIG. 6A to 6D describes a tracer release system 300 which has an alternative valve arrangement to FIGS. 5A to 5D configured to close the outlets above a pre-set production flow rate threshold and open below the threshold. The valves are closed during normal high production and open in temporary low production rate.

The valve assemblies 326*a* and 326*b* of tracer release apparatus 316*a* and 316*b* are configured to open above a pre-set production flow rate threshold and close above the threshold level.

Figure 6A:
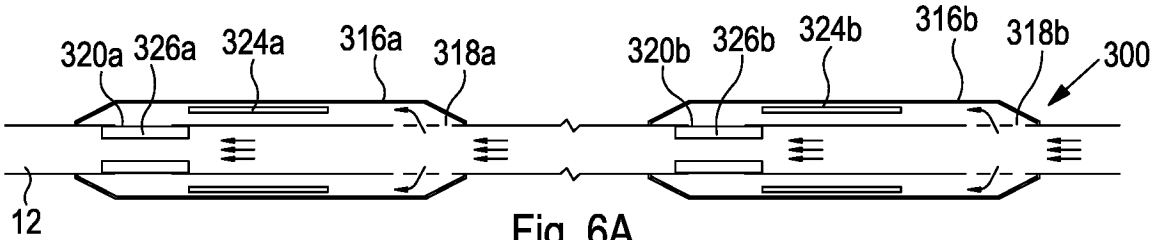
FIGS. 6A to 6D are enlarged sectional views of two tracer release apparatus of the tracer release system of FIG. 1 showing operation steps for a long tracer release apparatus shut in in a well with a normally high production rate.

During normal high production the flow rate is above the pre-set production flow rate threshold and therefore the valve assemblies 326*a* and 326*b* remain closed as shown in FIG. 6A.

Figure 6B:
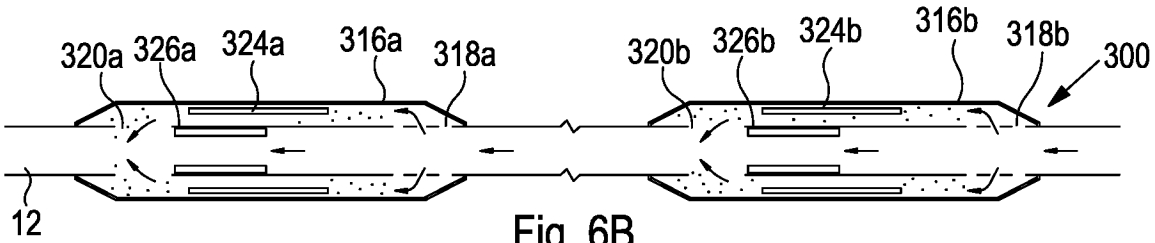

To release the tracer a choke assembly connected to the production tubing is adjusted to reduce the production flow to a second flow rate which it significantly lower than the pre-set threshold for the valve assemblies 326*a* and 326*b*. As a result, valve assemblies 326*a*, 326*b* open simultaneously allowing the built up concentrations of tracer molecules in tracer release apparatus 316*a*, 316*b* to be released simultaneously as shown in FIG. 6B.

Figure 6C:
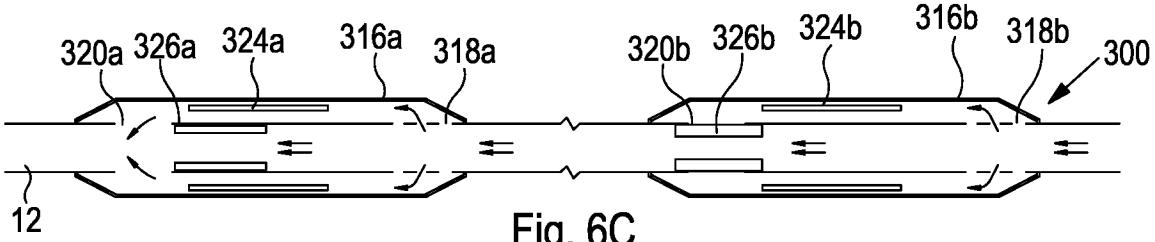
Figure 6D:
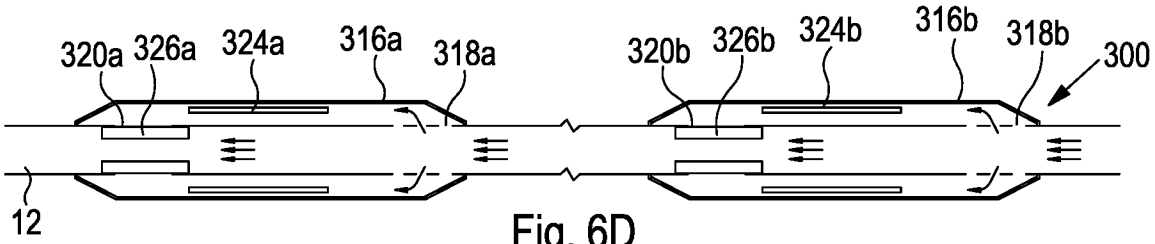

To shut in the tracer release apparatus the choke assembly is subsequently adjusted to increase the production flow to a third flow rate to close valve assembly 326*b* as shown in FIG. 6C. Due to variations in localised pressure further adjustment of the choke is required back to the first flow rate to reach the pressure differential required to close the valve 326*a* and outlet 320*a*.

Figure 7A:
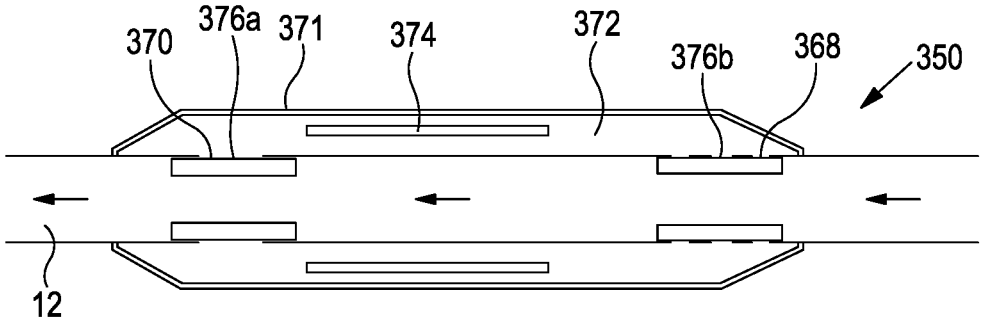
FIGS. 7A to 7C are enlarged sectional views of a tracer release apparatus with two valve assemblies in accordance with an aspect of the invention showing operation of an inlet valve and outlet valve for a long tracer release apparatus shut in in a well with a normally low production rate.

FIG. 7A shows a tracer release apparatus 350 comprising two valve assemblies 376*a* and 376*b*. In this example the valve assemblies are velocity valves.

The tracer release apparatus 350 has an inlet 368 and an outlet 370 in fluid communication with a production pipe 12. The tracer release apparatus has a flow passage 372 which comprises a tracer material 374. The tracer material may be disposed in the flow passage to allow fluid to pass around the tracer in the passage 372. The tracer material 374 is designed to release tracer molecules or particles when exposed to a target fluid i.e. oil, gas or water.

A first valve 376*a* has a movable member for selectively opening and closing the outlet 370 to control the flow of fluid from the flow passage 372 to the production pipe. A second valve 376*b* is mounted for selectively opening and closing the inlet 368

In the example show in FIG. 7A the valve assembly is mounted on the outside wall of the flow passage 372. However, it will be appreciated that the valve assembly may be mounted on an inside wall of the tracer release apparatus.

Figure 7B:
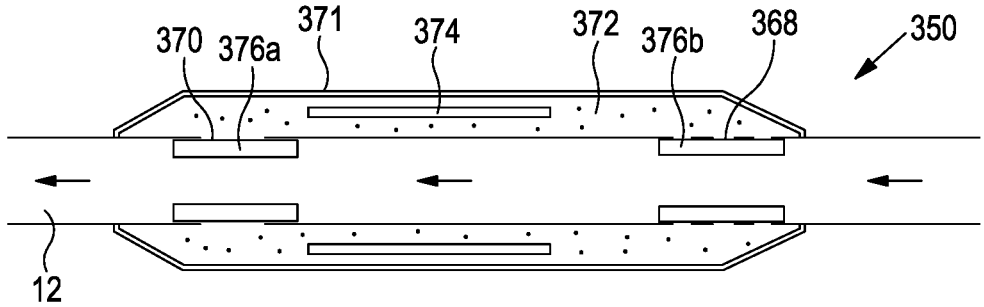
Figure 7C:
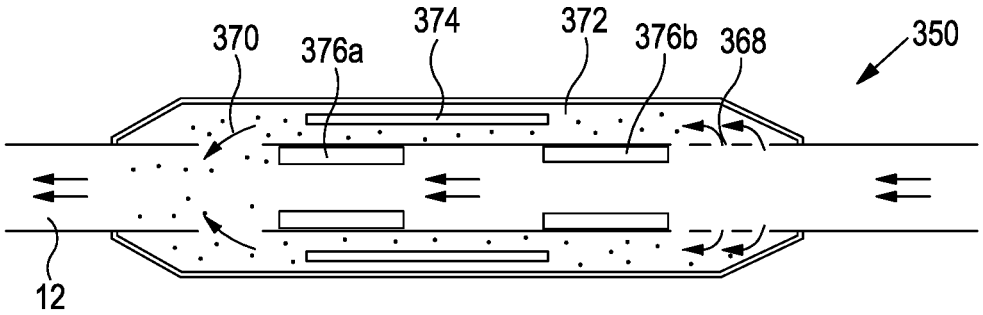

FIG. 7A to 7C show steps in the operation of two valve assemblies in the tracer release apparatus. This has particular application when the fluid has high mobility such as a gas to prevent cross flow or in heterogenic reservoirs with high pressure differences between the zones in the well. The tracer release apparatus in FIG. 7A is designed to provide a long tracer release apparatus shut in to allow a tracer cloud to build up.

The valve assemblies 376*a* and 376*b* are configured to open above a pre-set production flow rate threshold and close below the threshold. During normal low production as shown in FIG. 7A, the flow rate is below the pre-set production flow rate threshold and valve assemblies 376*a* and 376*b* close outlet 370 and inlet 368 respectively. The tracer chamber is sealed and the fluids surrounding the tracer material in the fluid volume of the tracer chamber becomes saturated with tracer particles.

A volume of fluid in contact with the tracer material in the flow passage 372 allows a tracer cloud to build up as shown in FIG. 7B. The choke assembly is adjusted to temporarily increase the flow in the production pipe above the pre-set production flow rate threshold which actuates the valve assemblies 376*a* and 376*b* to open outlet 370 and inlet 368 respectively allowing the tracer cloud to be flushed out of the tracer release apparatus.

Figure 8A:
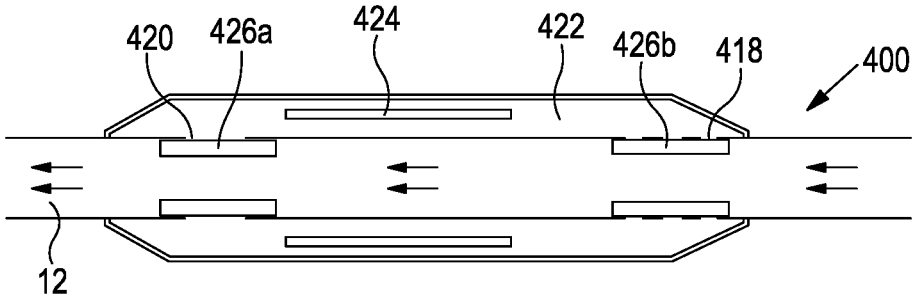
FIGS. 8A to 8C are enlarged sectional views of a tracer release apparatus with two valve assemblies in accordance with an aspect of the invention showing operation of an inlet valve and outlet valve for a long tracer release apparatus shut in in a well with a normally high production rate.
Figure 8B:
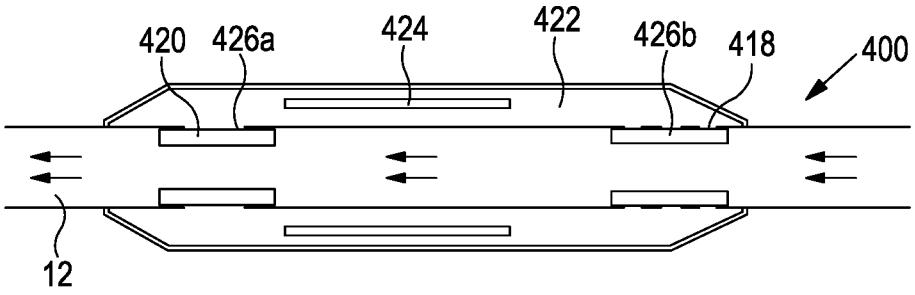
Figure 8C:
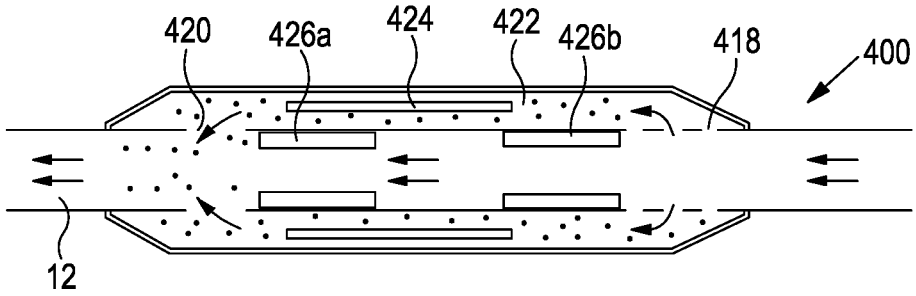

In FIG. 8A to 8C, the tracer release apparatus 400 is designed for use in a normal high production well. The valve assemblies 426*a* and 426*b* are configured to open outlet 420 and inlet 418 respectively below a pre-set production flow rate threshold and close outlet 420 and inlet 418 respectively above the threshold.

During normal high production the flow rate is above the actuation threshold of valves 426*a* and 426*b* and therefore the valve 426*a* and 426*b* are closed. The tracer chamber is sealed and the fluids surrounding the tracer material in the fluid volume of the tracer chamber becomes saturated with tracer particles. A volume of fluid in contact with the tracer material in the flow passage 422 allows a tracer cloud to build up.

To release the tracer cloud the choke assembly is adjusted to temporarily reduce the flow in the production pipe below the pre-set production flow rate threshold which actuates the valve assemblies 426*a* and 426*b* to open outlet 420 and inlet 418 respectively so that the tracer cloud to be flushed out of the tracer release apparatus.

Figure 9A:
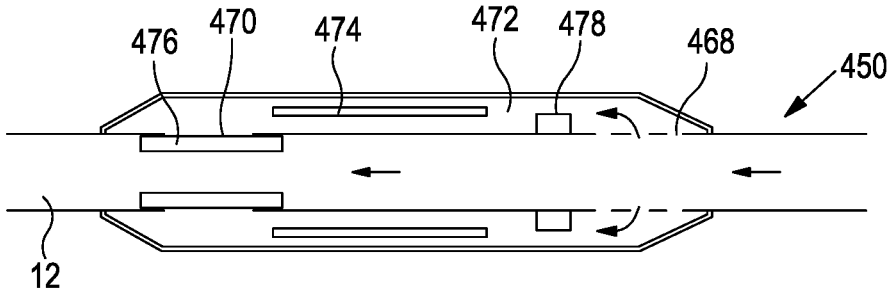
FIGS. 9A to 9C are enlarged sectional views of a tracer release apparatus with an inlet in fluid communication with the annulus in accordance with an aspect of the invention.
Figure 9B:
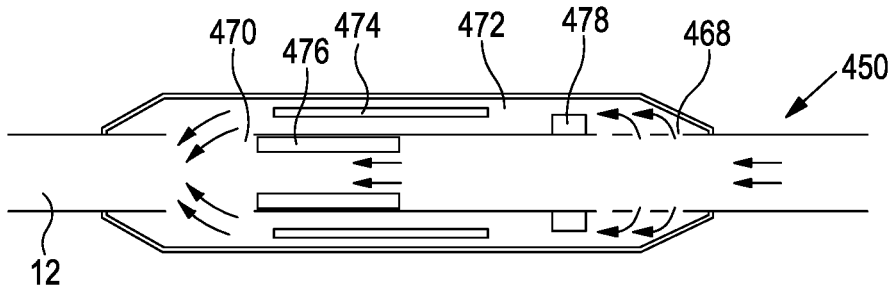
Figure 9C:
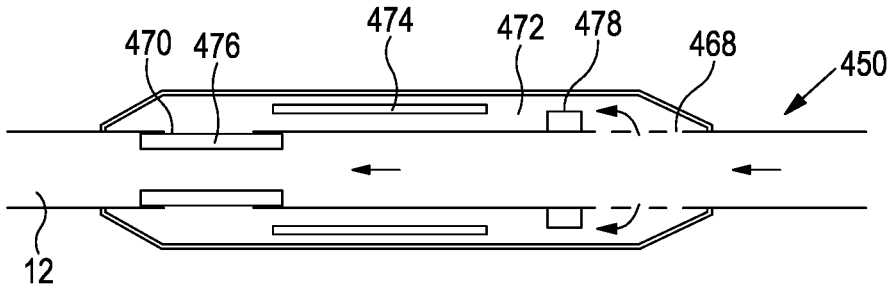

FIG. 9A shows an alternative arrangement of the tracer release apparatus designed for low flow velocity well where it may be difficult to generate a differential pressure between the flow passage and production tubing.

The flow passage 472 of tracer release apparatus 450 comprises a flow restriction device 478. The flow restriction device is located or affixed to an inner wall of the tracer release apparatus so as to extend inwardly into the flow passage to reduce the flow area of the flow passage. In this example the flow restriction device is a nozzle. However, it will be appreciated that other restriction device types may be used.

The nozzle 478 is arranged between the inlet 468 and the outlet 470 in the flow passage 472. The nozzle 478 allows a pressure gradient to be created between the flow passage 472 and the production tubing. In low flow production wells, the choke assembly may not be capable of increasing to a rate above a pre-set production flow rate threshold. By providing the flow restrictor device in the tracer release apparatus the pressure differential is accentuated allowing actuation of the valve assembly.

Figure 10A:
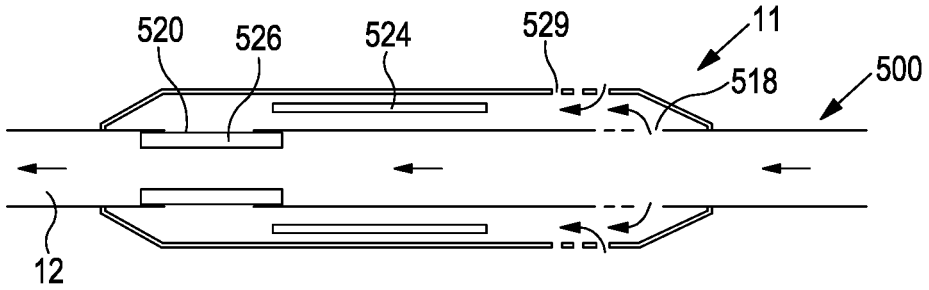
FIGS. 10A to 10C are enlarged sectional views of a tracer release apparatus with a restriction device showing operation steps for a tracer release apparatus shut in in a well with a normally low production rate.
Figure 10B:
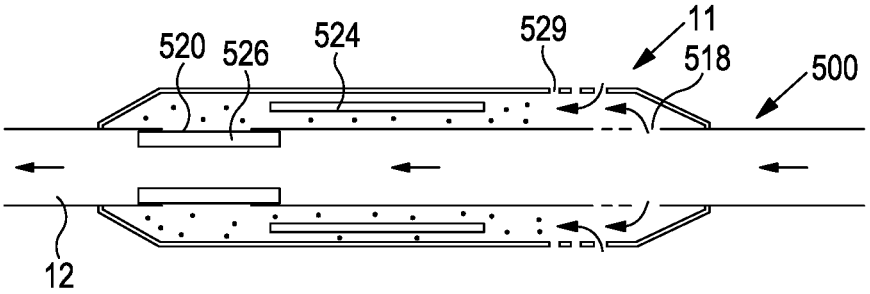
Figure 10C:
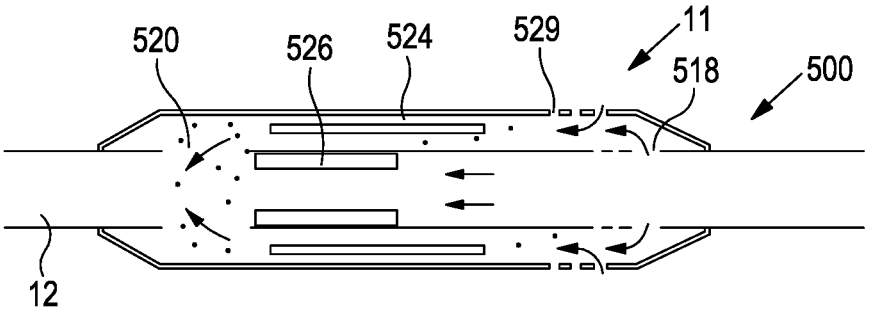

FIG. 10A to 10C shows an enlarged section of an alternate tracer release apparatus arrangement for exposing tracer material to fluid from the production tubing and the annulus 11. The tracer release apparatus 500 is installed on a production tubing 12. The tracer release apparatus has a first inlet 518 in fluid communication with the production tubing and a second inlet 529 in fluid communication with the annulus 11. The tracer release apparatus has an outlet 520. Arrows in FIGS. 10A to 100 denote the direction of fluid travel.

The tracer release apparatus 500 has a flow passage 522 which comprises a tracer material 524. The tracer material may be disposed in the flow passage to allow fluid to contact the tracer material and pass around the tracer material in the passage 522. The tracer material 524 is designed to release tracer molecules or particles when exposed to a target well fluid i.e. oil, gas or water.

The tracer release apparatus has a differential pressure valve 526 is mounted for selectively opening and closing the outlet 520 to control the flow of fluid from the flow passage 522 to the production pipe.

The valve assembly 526 is a differential pressure operated valve designed to to open and close in response to changes in differential pressure. In this case the change in differential pressure is controlled by adjusting the production flow rate. The valve assembly is set to open above a pre-set production flow rate threshold and close below the set threshold.

During normal production as shown in FIG. 10A the production flow rate is below the pre-set flow rate threshold and therefore the differential pressure valve remains open. Fluid passes from the annulus 11 through inlet 529 and from production tubing 12 through inlets 518 into the flow passage 522. The tracer material is exposed to the fluid and tracer molecules are released into the fluid. The tracer enriched fluid passes through the outlet into the production pipe and it carried by the production fluid to surface.

Fluid in the flow passage 522 is prevented from exiting the flow passage and the concentration of tracer molecules builds up.

To open the outlet 520 the choke assembly is adjusted to increase the production flow rate above the pre-set threshold for the valve. As shown in FIG. 100 the valve assembly is opened allowing fluid and high concentration of tracer to pass through the outlet 520 into the production tubing 12.

Figure 11:
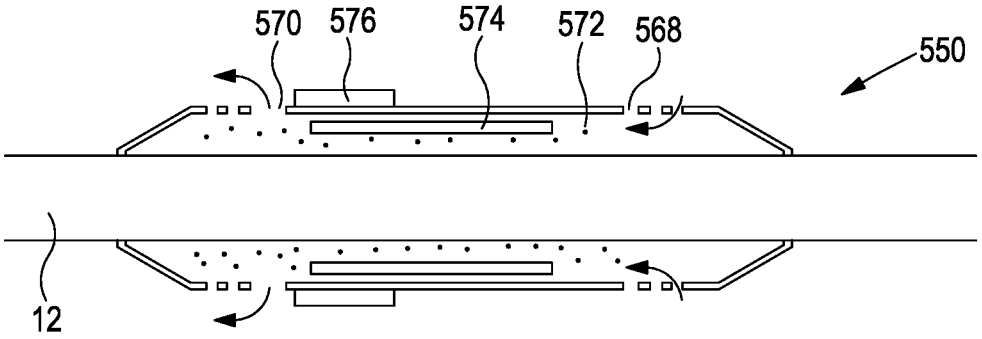
FIG. 11 is an enlarged sectional view of a tracer release apparatus with an inlet and outlet in fluid communication with the annulus in accordance with an aspect of the invention.

FIG. 11 shows an enlarged section of an alternate tracer release apparatus arrangement for exposing tracer material to fluid from the annulus and releasing the tracer cloud into the annulus. The released tracer cloud may enter the production tube at an inlet downstream of the tracer release apparatus. The tracer release apparatus 550 is installed on a production tubing 12. The tracer release apparatus has an inlet 568 in fluid communication with the annulus 11 and an outlet 570 in fluid communication with the annulus 11. Arrows in FIG. 11 denote the direction of fluid travel.

The tracer release apparatus 550 has a flow passage 572 which comprises a tracer material 574. The tracer material may be disposed in the flow passage to allow fluid to contact the tracer material and pass around the tracer material in the passage 572. The tracer material 574 is designed to release tracer molecules or particles when exposed to a target well fluid i.e. oil, gas or water.

A valve assembly 576 is designed to open and close the outlet in response to changes in differential pressure in fluid flow. In the examples show in FIG. 11, the valve member is mounted on an outside wall of the flow passage. However, it will be appreciated that the valve assembly may be mounted on an inside wall of the flow passage.

The tracer cloud is released into the annulus where it may enter the production tubing at an influx point further downstream and travels to surface.

The valve assemblies described above are configured to open or close when the valve is exposed to a differential pressure which reaches a predetermined level. For example, when a differential pressure created by a change in production flow results in a travelling sleeve moving to a closed position.

In the examples discussed above in FIGS. 1A to 11, the tracer material is a any luminescent tracer such as dye with narrow absorbance or quantum dots. Examples of suitable luminescent dye is Sulfo-Rhodamine B, absorbing dye is 2-[2-[2-Chloro-3-[2-(1,3-dihydro-1,3,3-trimethyl-2H-indol-2-ylidene)-ethylidene]-1-cyclohexen-1-yl]-ethenyl]-1,3,3-trimethyl-3H-indolium chloride, quantum dots can be few nm in size CdSe quantum dots. The particles for dye protection can be made of porous silica or any other material, particles can also have a core-shell structure.

However, it will be appreciated that other tracer types may be used including chemical, fluorescent, phosphorescent, magnetic, DNA and radioactive compounds may be used with corresponding detection equipment.

FIGS. 12A to 16B show different example valve assembly types that may be used in the tracer release assemblies described in FIGS. 1A to 11 above. The velocity valve assembly shown in FIG. 12A to 14B or differential pressure valve assemblies shown in FIGS. 15A to 16B may be used to permit, choke or prevent flow into and/or out from the tracer release apparatus.

Figure 12B:
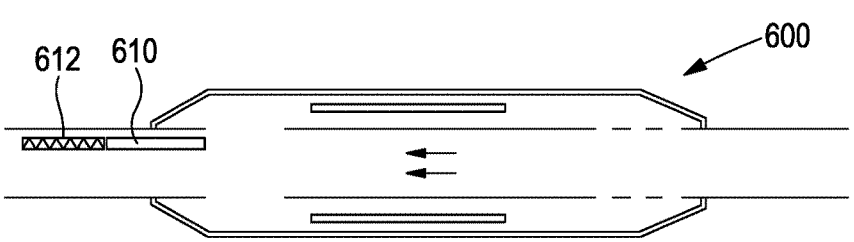
FIGS. 12A and 12B are schematic diagrams of components of a velocity valve assembly for use in a tracer release apparatus in accordance with an aspect of the invention.
Figure 12A:
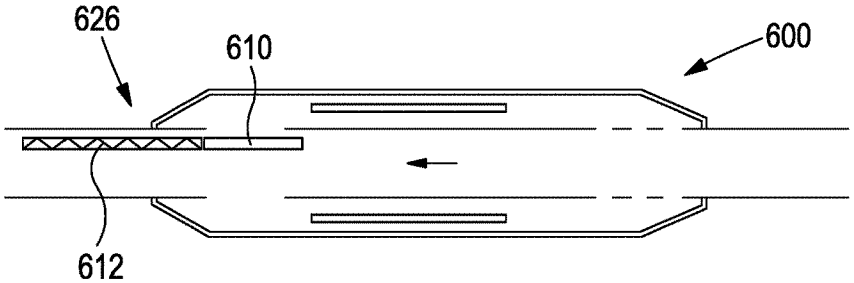

FIG. 12A shows a tracer release apparatus 600 with a velocity valve assembly 626. The velocity valve is located in the inner diameter of the production tubing. The velocity valve has an actuating sleeve 610 which is biased in FIG. 12A to a closed position by a spring 612. The valve actuating sleeve 610 is designed to move in a linear movement between valve closed position and open position shown in FIGS. 12A and 12B respectively.

In a first valve arrangement shown in FIG. 12A the spring 612 is a compression spring biased in a fully closed position in a low production flow. In response to a high production flow rate, the flow acting on the sleeve 610 is sufficient to compress the spring 612 moving the sleeve 610 to a fully open position. In a low production flow condition, the force acting on the sleeve 610 by the production flow is not sufficient to overcome the spring force of spring 612. The spring expands and moves the sleeve to a fully closed position as in FIG. 12B.

Figure 13B:
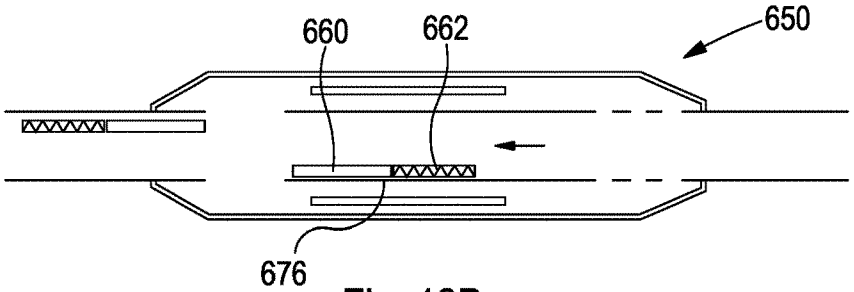
FIGS. 13A and 13B are schematic diagrams of components of a velocity valve assembly for use in a tracer release apparatus in accordance with a further aspect of the invention.
Figure 13A:
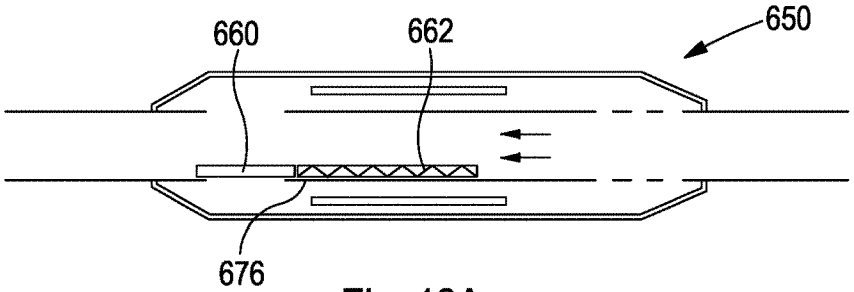

FIG. 13A shows a tracer release apparatus 650 with a velocity valve assembly 676. The spring 662 is a tension spring biased towards an open position. In response to a high production flow rate, such as during normal production, the flow acting on sleeve 660 is sufficient to overcome the spring force of spring 662. The spring is expanded moving the sleeve 660 to a closed position. In a low production flow condition, the force acting on the sleeve 662 by the production flow is not sufficient to overcome the spring force. The spring retracts and moves the sleeve to an open position as shown in FIG. 13B.

Although FIGS. 12A, 12B, 13A and 13B show the sleeve moveable between fully open and fully closed positions. It will be appreciated that the sleeve may be located at intermediate positions between the fully opened and fully closed. The sleeve may be set to be partially opened and partially closed depending on the production flow rate in order to throttle or choke flow through the valve.

Figure 14B:
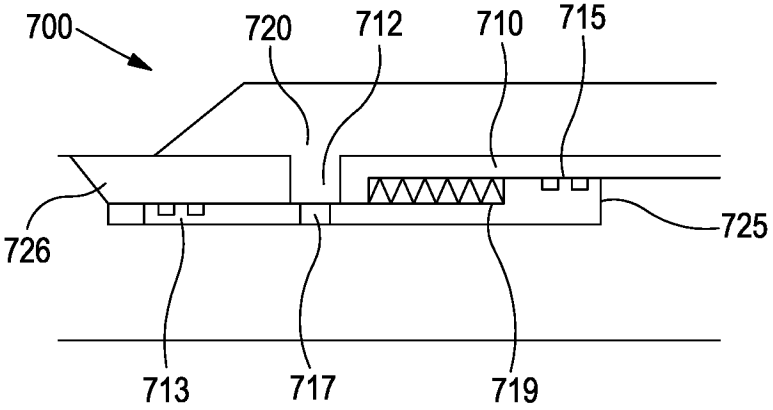
FIGS. 14A and 14B are schematic diagrams of components of a velocity valve assembly for use in a tracer release apparatus in accordance with an aspect of the invention.
Figure 14A:
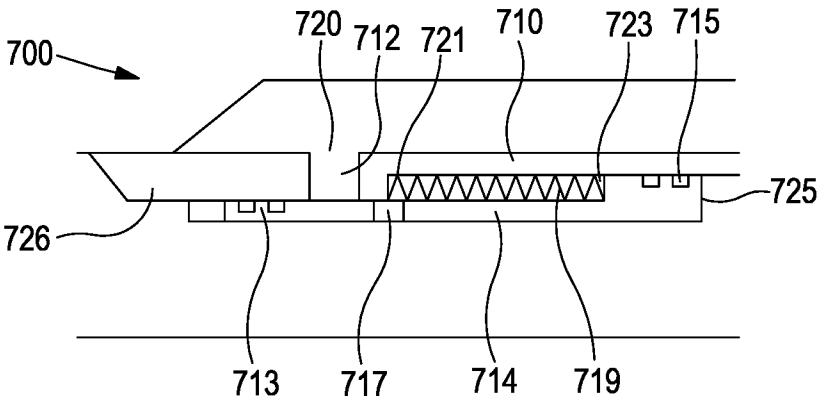

FIGS. 14A and 14B shows an enlarged view of a velocity valve assembly 726 in a tracer release apparatus 700. The other components of the apparatus have been removed for clarity. The valve assembly has a valve body 710 having a port 712 through the wall of the valve body which is aligned with the outlet 720 of the tracer release apparatus. A sleeve 714 supported by the valve body with seals 713 and 715 at each end. The sleeve is axially moveable relative to the valve body. The sleeve 714 has a port 717. The sleeve is moveable from a closed position where the sleeve port 717 is not aligned with port 712 and outlet 720 as shown in FIG. 14A, to an open position where the sleeve port 717 is aligned with port 712 and outlet 720 as shown in FIG. 14B.

A sleeve biasing mechanism, in this case a spring 719 is located between a shoulder 721 on the valve body and shoulder 723 on the sleeve.

In this example the sleeve biasing mechanism is a spring 721 it will be appreciated that other biasing mechanisms may be used such as a pressure chamber containing a gas such as nitrogen.

The sleeve 714 acts as a piston which is axially movable by production flow applied to sleeve 714 via shoulder 725 of the sleeve. When the fluid flow applied to shoulder 725 reaches a predetermined amount the pressure force compresses spring 714 to axially move the sleeve such that the sleeve port 717 is brought into alignment with port 712 and outlet 720.

The sleeve will remain in the open position as shown in FIG. 14B as long as the force from production flow is sufficient to keep the spring 714 compressed.

Once the flow rate of the production flow is reduced below a predetermined amount the force of the spring can overcome the pressure force acting on the via shoulder 725 of the sleeve. The sleeve is moved to a closed position where the sleeve port 717 is not in alignment with port 712 and outlet 720.

The force on acting on the sleeve can be adjusted by reducing or increasing flow rate in the production tubing by controlling a choke connected to the production tubing.

In this example the spring in a compression spring. However, it will appreciate that a tension spring may be used.

Figure 15A:
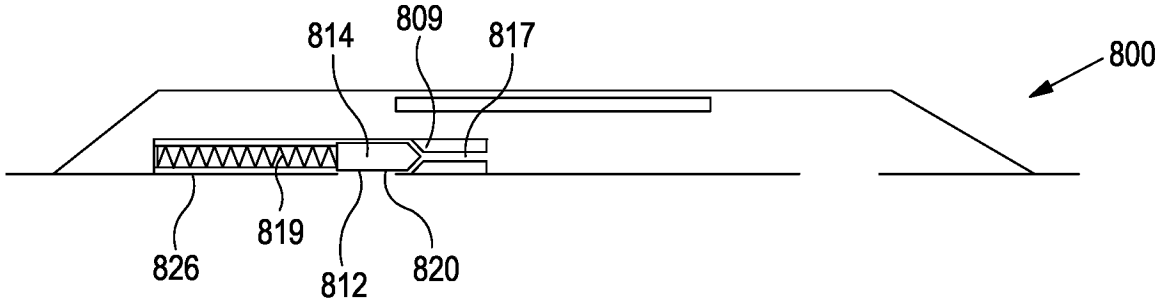
FIGS. 15A and 15B are schematic diagrams of components of a differential pressure valve assembly for use in a tracer release apparatus in accordance with a further aspect of the invention.
Figure 15B:
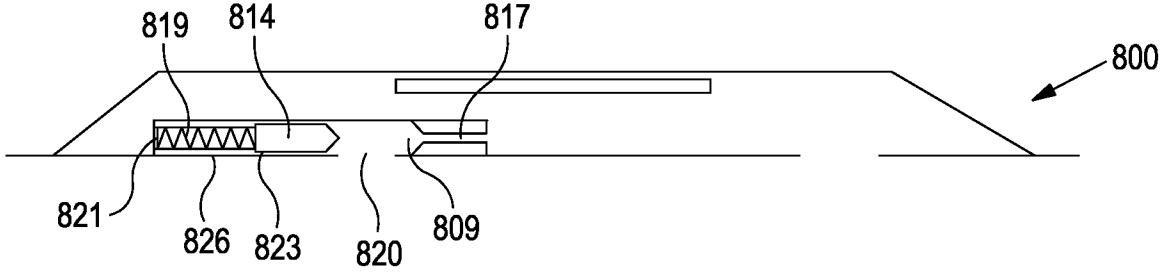

FIGS. 15A and 15B shows an enlarged view of a differential pressure operated valve assembly 826 in a tracer release apparatus 800. The valve assembly 826 is located within the tracer release apparatus to avoid restriction of the inner diameter of the production tubing. The other components of the apparatus have been removed for clarity.

The valve assembly 826 has a valve body 810 having an outlet port 812 through the wall of the valve body which is aligned with the outlet 820 of the tracer release apparatus. A sleeve 814 is axially moveable relative to the valve body. The valve body 810 has an inlet port 817 in fluid communication with a valve seat 819. In a valve closed position the sleeve is located in the valve seat 809 and the sleeve covers outlet port 812 and outlet 820 as shown in FIG. 15A. In a valve open position, the sleeve is moved axially away from the valve seat and the outlet port 812 and outlet 820 are in fluid communication with the inner volume within the tracer release apparatus as shown in FIG. 15B.

A sleeve biasing mechanism, in this case a spring 819 is located between shoulder 821 on the valve body and shoulder 823 on the sleeve.

In this example the sleeve biasing mechanism is a spring 821 it will be appreciated that other biasing mechanisms may be used such as a pressure chamber containing a gas such as nitrogen The sleeve 814 acts as a piston which is axially movable by differential in pressure between the tracer release apparatus and the production tubing. Pressure from the tracer release apparatus is applied to sleeve 814 via inlet port 817. Pressure from the production tubing is applied to sleeve 814 via outlet port 812 and outlet 820. When a pressure applied to inlet port 817 reaches a predetermined amount the pressure force compresses spring 814 to axially move the sleeve away from valve seat 809 such that the sleeve uncovers outlet port 812 and outlet 820.

The sleeve will remain in the open position as shown in FIG. 15B as long as the differential pressure between the tracer release apparatus and the production tubing is sufficient to keep the spring 814 compressed.

Once the pressure differential between the tracer release apparatus and the production tubing is reduced below a predetermined amount the force of the spring can overcome the pressure force acting on the sleeve. The sleeve is moved to a closed position where the sleeve is in the valve seat 809.

Although the above examples described in FIGS. 12A to 15B the valves are described a normally closed it will be appreciated that the valves may be set to be normally open and move to a closed position in response to a change in flow velocity and/or a change in differential pressure.

The pressures on acting on the sleeve can be adjusted by reducing or increasing pressure in the production tubing by controlling a choke connected to the production tubing.

In this example the spring in a compression spring. However, it will appreciate that a tension spring may be used.

Figure 16C:
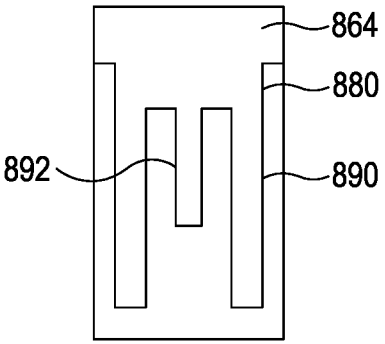
FIGS. 16A, 16B and 16C are schematic diagrams of components of a control mechanism for use in a tracer release apparatus in accordance with an aspect of the invention.
Figure 16B:
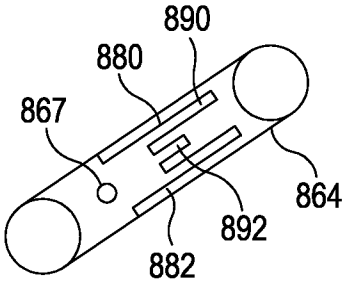
Figure 16A:
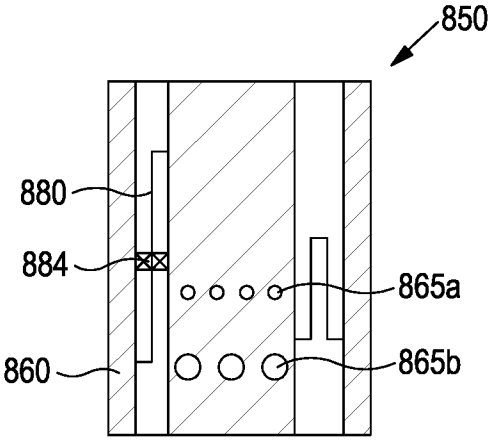

FIG. 16A shows a valve control mechanism 850 for controlling the actuation of the valve. In this example the valve is a sleeve valve.

The control mechanism 850 has a sleeve 864 with a keyway 880 best shown in FIG. 16B. The keyway 880 comprises a plurality of axial slots or tracks 882 formed around the outer surface of sleeve. A stationary indexer pin 884 mounted on the valve body 860 is located between the sleeve and the valve body and is configured to move within the keyway. The sleeve has a sleeve port 867 which is configured to be aligned with the outlet of the tracer releaser apparatus when in an open valve position. The sleeve port 867 is configured to be covered when in a closed valve position.

Axial movement of the sleeve 864 in response to a fluid velocity change such as described in FIGS. 12A, 12B, 13A and 13B or in response to a change in differential pressure such as described in FIGS. 14A and 14B results in the indexer pin 884 moving in the keyway 880.

Depending on the design of the keyway 880 the sleeve 864 is prevented from being moved to an open position until a selected number of fluid pressure or fluid velocity cycles have been applied to sleeve. Alternatively, the sleeve 864 is prevented from being moved to a closed position until a selected number of fluid pressure or fluid velocity cycles have been applied to sleeve.

As the indexer pin 884 has cycled through the keyway 880, the sleeve 864 is moved to actuate the valve between a closed or open position. The tracks 882 in the keyway having different lengths and are used to control the actuation of the valve.

In the example shown in FIGS. 16B and 16C, the keyway 880 has alternate long tracks 890 and short tracks 892 arranged around the periphery of the sleeve. When the indexer pin is located within the long track 890 the valve is in the open position and the sleeve port is aligned with outlet of the tracer release apparatus. Movement of the sleeve in response to a flow velocity or differential pressure moves the sleeve into the short track. When the pin is located in the short track 892 the sleeve moves to a position in which the sleeve port is not aligned with outlet of the tracer release apparatus. Further movement of the sleeve in response to a flow velocity or differential pressure moves the sleeve but if the indexer pin is still within the short track so the valve remains in the closed position.

A further embodiment of the valve control mechanism 850 is that the sleeve may have different sizes of sleeve ports 865*a*, 865*b* as best shown in FIG. 16A. Each port size may correspond with different axial tracks 882 in the keyway 880. For example, when the index pin 884 is in a first track the sleeve ports 865*a*, 865*b* may be blocked and the valve is closed. When the index pin 884 is a second track the sleeve is moved to align a small sleeve port or series of small ports 865*a* with the tracer releasing outlet thereby releasing the tracer gradually from the apparatus through the small sleeve port. However, when the index pin 884 is located in a third track the sleeve is moved to align a larger sleeve port or series of larger ports 865*b* with the outlet of the tracer releasing apparatus thereby releasing the tracer quickly from the apparatus through the large sleeve port.

Another feature of the valve control mechanism may be set such that the sleeve port may be located at intermediate positions between fully opened and fully closed corresponding to different axial tracks in the keyway. This allow for the controlled opening, closing, partially opening or partially closing of the valve.

Although the above examples describe the control mechanism being used to control the actuation of a valve to open and close an outlet on the tracer release apparatus, it will be appreciated that the control mechanism may be used to alternatively or additionally control the actuation of a valve to open and close an inlet on the tracer release apparatus.

Figure 17A:
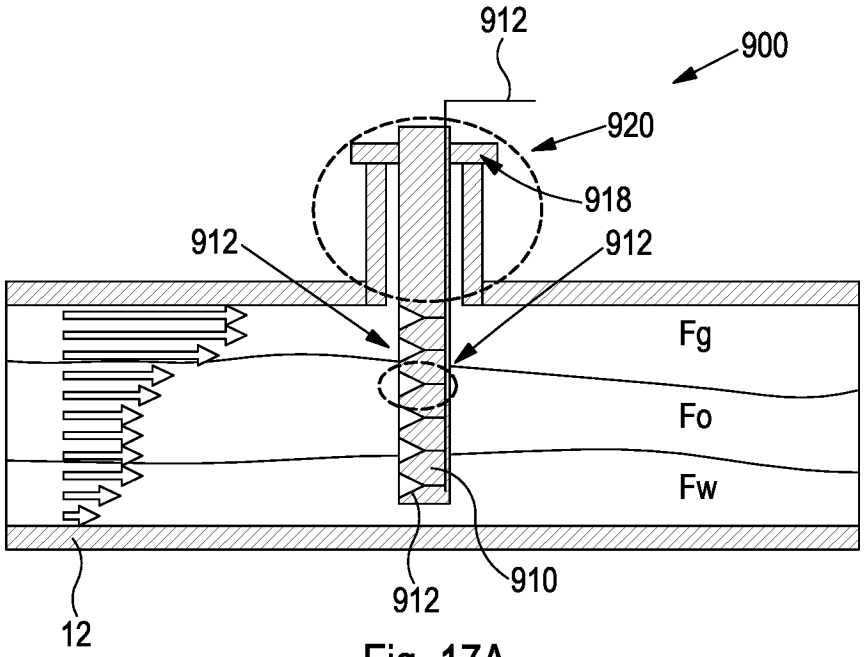
FIGS. 17A, 17B and 17C are schematic diagrams of components of a probe for use in detecting released tracer in accordance with an aspect of the invention.

FIG. 17A is a schematic diagram of the probe 900 used to detect tracer in the production flow. The probe 900 is installed in the production pipe 12. As shown in FIG. 17A the flow comprises three flow components oil (Fo), gas (Fg), and water (Fw).

The probe 900 has a number of detectors 912 arranged on the probe body 910 arranged at different depths to detect tracer in different phase layers in segregated flow.

A communication line 914 connects the detectors 912 to analysis equipment 915 via measurement connector 920. The communication line 914 may be fibre optic cable for excitation and detection of tracers. A flange 918 or similar connection/access port, could be a sand detection port is arranged in the pipe wall.

Figure 17C:
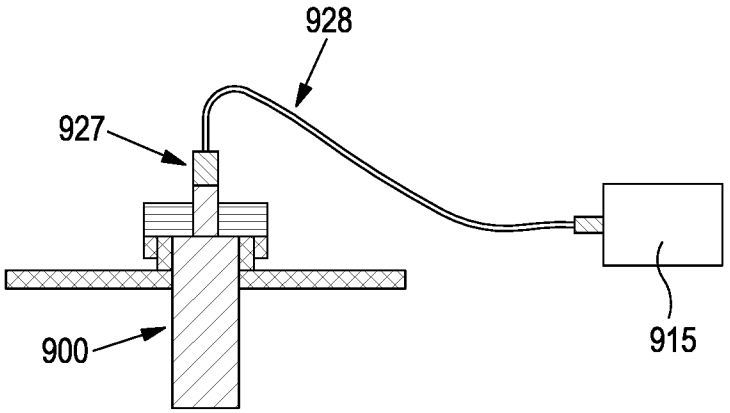
Figure 17B:
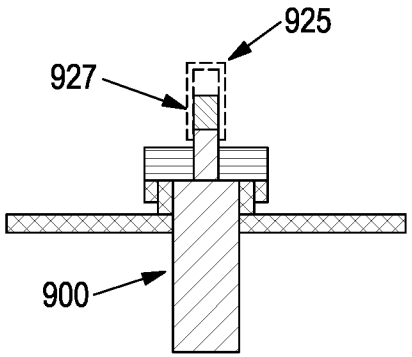

FIG. 17B shows the position of a protective cap 925 located over a fiber connector 927 of the probe 900 during installation on the pipe 12 and the removal of the cap in FIG. 17C during operation. FIG. 17C shows that when the cap 925 is removed a fiber bundle 928 connected to analysis equipment 915 is attached to the fiber connector 927.

The probe 900 can be inserted into a producing pipe 12 using standard off the shelf equipment such as the Roxar Hydraulic Retrieval tool or utilizing existing access points to the production pipe 12 such as ball-valve, gate-valve or dedicated flange for instrumentation preferably during operation. There are known insertion and retrieving techniques based on hydraulic and mechanical principles offered by for example Roxar and Mirmorax.

Figure 18C:
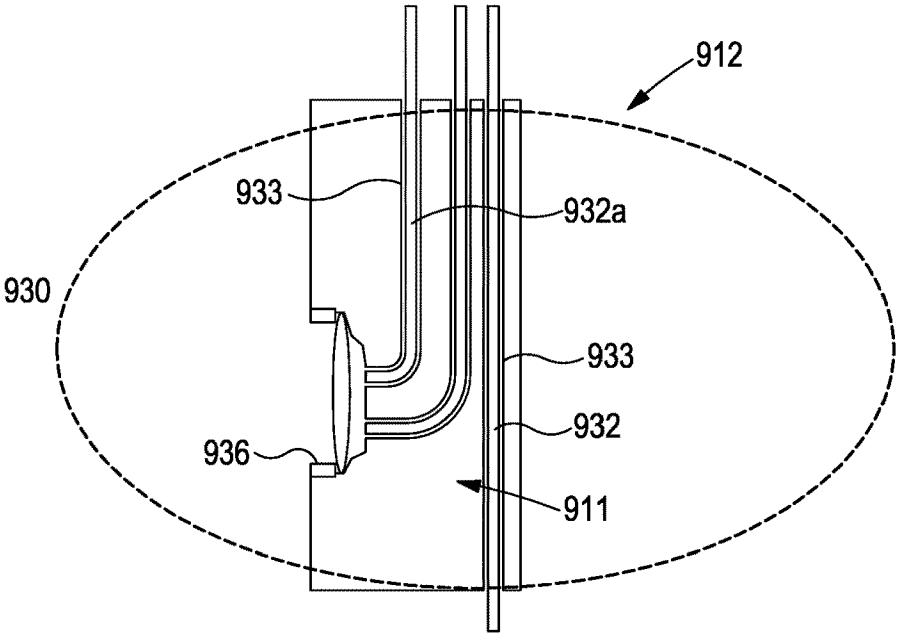
FIGS. 18A, 18B and 18C are alternative sectional view of components of a probe of FIG. 17A.
Figure 18B:
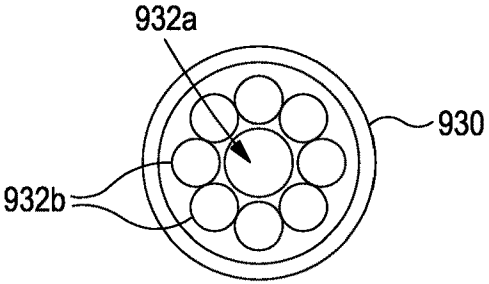
Figure 18A:
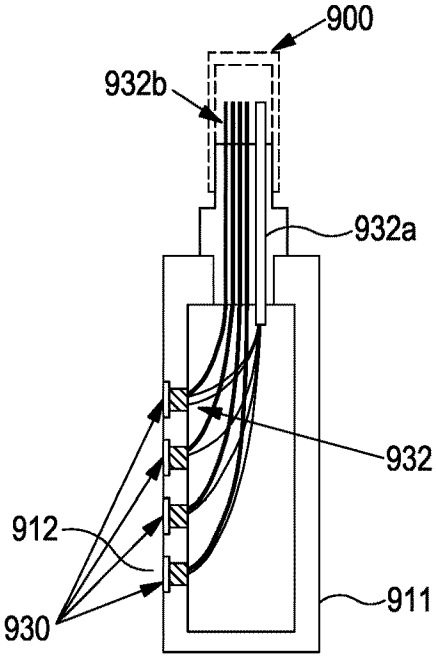

FIG. 18A is a simplified cross-sectional side view of the probe 900. The probe has a hollow body 911 and sealing threads 913 for installation of the probe. The probe has multiple detectors 912 arranged on the hollow body. The detectors have inspection windows 930 which may be made of a chemical and mechanical resistant glass. Behind the windows 930 are arranged light transmitting fibers bundles or single fibers 932*a* connected to an excitation device for excitation the tracer in the production flow. Behind the windows 930 are also arranged light receiving fibers bundles or single fibers 932*b* connected to signal receiving equipment.

The transmitting fibers bundles 932*a* are connected to an excitation source and are used to transmit light into the fluid. Receiving fibers 932*b* are configured to convey received signals to analysis equipment.

FIG. 18B is a cross section of a possible arrangement of the optical fibers behind the inspection window 930, with light transmitter fibers 932*a* surrounding the light receiving fibers which are connected to signal receiving equipment.

FIG. 18C is a simplified illustration showing an enlarged section of a detector 912. The probe has a transparent window with either a parallel surface window or a lens shaped window for focusing light emitted by the external phase (fluid) is arranged facing a possible flow (not shown).

A fiber optic cable 932*a* for transmitting light from surrounding fluid (emitted wavelength) out of the probe and to external detection unit outside of the pipe is illustrated. If the transparent window is a lens then the end of the fiber should be at, or close to focal point of the lens in order to collect as much emitted light as possible. The main body 911 of probe is illustrated in FIG. 18C with channels 933 made for supporting fiber optic cables through and cavities for holding lenses. Through the body a fiber optic cables 932 feed though for other detector locations. Around the lens/window there is indicated fixating screw connection for holding the window in place, preferably with sealing o-ring 936 or similar fitting on each side of the window for isolation.

In the examples discussed above FIGS. 1A to 11, the tracer material and the release tracer molecules is a luminescent dye with narrow absorbance or quantum dots. Examples of suitable luminescent dye is Sulfo-Rhodamine B, absorbing dye is 2-[2-[2-Chloro-3-[2-(1,3-dihydro-1,3,3-trimethyl-2H-indol-2-ylidene)-ethylidene]-1-cyclohexen-1-yl]-ethenyl]-1,3,3-trimethyl-3H-indolium chloride, quantum dots can be few nm in size CdSe quantum dots. The particles for dye protection can be made of porous silica or any other material, particles can also have a core-shell structure.

The spectral window where tracers can be detected by the probe 900 is from 500-2300 nm. The spectral window is wider for the oils with low asphaltenes and resins content such as light oils and condensates and is narrower for heavy crudes, 1000-2300 nm. Even in this wavelength range a typical oil transmits only 10-30% of the light through 2 mm thick film, and only 1-9% through 4 mm. However, the use of the back scattered luminescence allows to overcome this complication. The detectors are then be suitable to detecting luminescent.

The method of detecting the released tracer from the tracer release apparatus involves emitting light from a light source into the production flow via the transmitting fibers 932*a* in each detector 912. The light generates a tracer-specific luminescence in the tracers present in the flow. The backscattered light is collected and received via the receiving fibers 932*b* in each detector 912.

The received signal is processed to calculate light intensity values of received light representing the tracers and recording the light intensity values over an appropriate wavelength range. An advantage of emitting light into detectors arranged in an array across the flow, or along a sufficient portion of the cross section is that all phases present may be covered. The light intensity is sufficient for identifying peaks of tracer luminescence.

Characteristics of each tracer may be calculated and monitored including concentration and arrival times based on light intensity values. Such a characteristic feature may be the peak of the signal as above.

The method may involve calculating differences in arrival time between the tracer responses from each tracer release apparatus location for all monitored phases. The spatial differences between the known tracer release apparatus locations and the calculated arrival times, allow for influx wellbore inflow profiles to be estimated and monitored.

Figure 19:
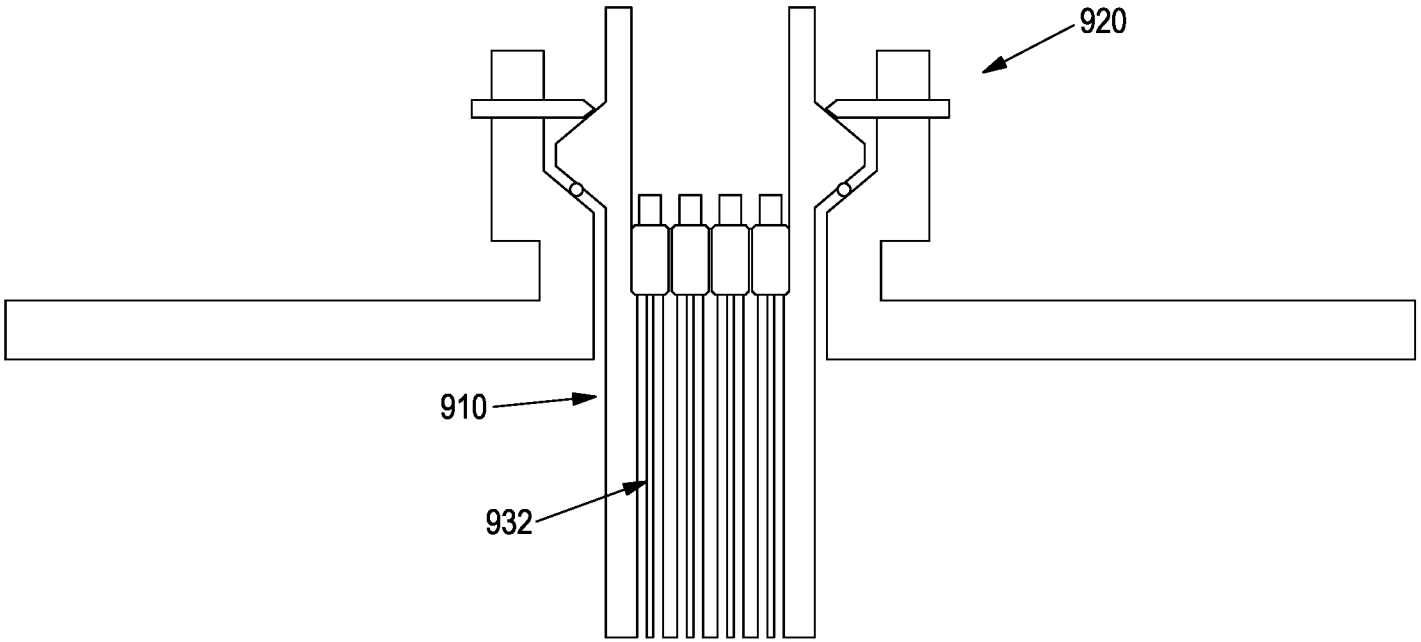
FIG. 19 is a sectional view of the measurement connector of the probe of FIG. 17A.

FIG. 19 is a cross sectional view of the measurement connector 920. The measurement connected is located above the transmitting 932*a* and receiving fibers 932*b*. Optical feed though the connector provides a seal between fibers and the main body of probe are illustrated. After installation of probe 900, external instrumentation (light source and detector) are connected with standard connections. Optical feed through connections may be found for single fibers and for bundles of fibers. For instance, as supplied by SQS Vlaknova Optika as. Other features indicated are: Set screw securing the probe in place, flange permanently attached to the pipe and, O-ring or other seal between probe and flange.

In the above examples described in FIGS. 17 to 19, the tracer detection, monitoring and concentration is performed online in real time. However, it will be appreciated that alternatively and/or additionally samples may be collected for later analysis offline.

The detection and/or analysis of tracer in production fluid may be a separate method to the release of tracer from the tracer release apparatus and/or the collection of samples. Samples may be collected and the tracer detected at a time or jurisdiction which is separate and distinct from the location of well and therefore the collection of the samples.

In the above examples the valve is a sleeve valve. However, it will be appreciated that other valve types may be used.

Figure 20A:
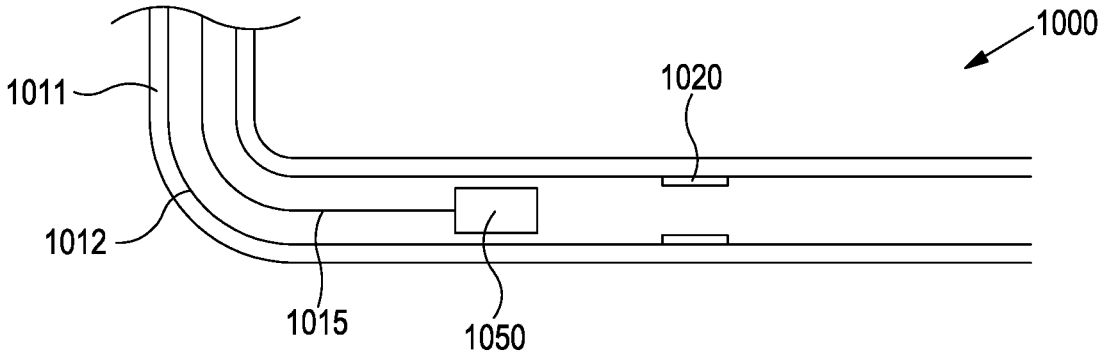
FIGS. 20A and 20B are simplified sectional diagrams through a production well showing the steps of installing a tracer release system in accordance with an aspect of the invention.

FIG. 20A shows a simplified section through part of a production well 1000. A central production tubing 1012 is arranged in the well surrounded by annulus 1011. A landing nipple 1020 is located in the production tubing at the time the wellbore is completed. FIG. 20A shows the retrofitting installation of the tracer release apparatus 1050 into the without the need to remove the production tubing from the wellbore.

Figure 20B:
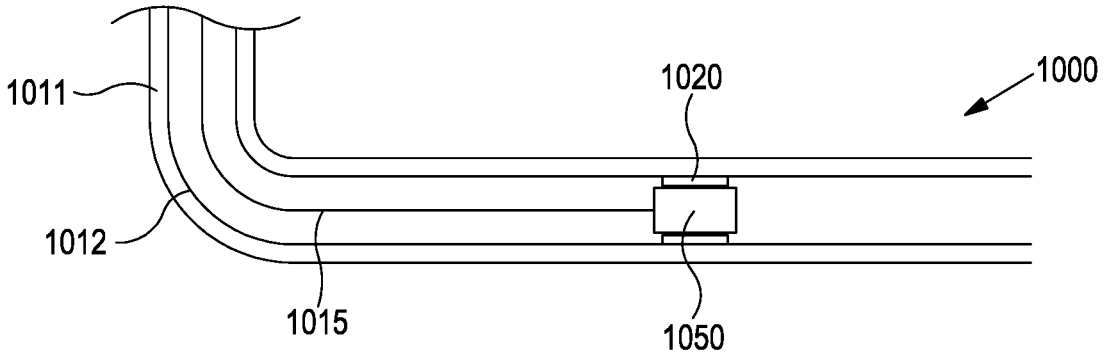

As shown in FIG. 20A the tracer release apparatus 1050 is conveyed through the production tubing from surface by wireline 1015. It will be appreciated that other conveyances methods may be used including slickline and coiled tubing. The tracer release apparatus 1050 is dimensioned such that it engages and connects to the landing nipple 1020 to install the tracer release apparatus 1050 as shown in FIG. 20B.

The tracer release apparatus 1050 can be installed and/or replaced without having to retrieve the production tubing to the surface. For example the tracer release apparatus may be retrieved and/or replaced due to a component failure or requirements to change or replace the tracer material or the operating parameters of the tracer release apparatus. Additionally or alternatively, a component of the tracer release apparatus 1050 can be retrieved, replaced or adjusted without having to retrieve the tracer release apparatus 1050 to the surface. For example a valve on the tracer release apparatus may be retrieved, replaced or adjusted due to valve failure or requirements to change the valve type, or the operating parameters of the valve.

It will be appreciated that depending on the operation and configuration of the tracer release apparatus 1050 the landing nipple may have ports in the side wall of the nipple. The ports may be in communication with the production tubing and/or the annulus and when the tracer release apparatus is installed on the nipple the tracer release apparatus 1050 may be in fluid communication with the production tubing and/or the annulus via the ports in the nipple.

Figure 21A:
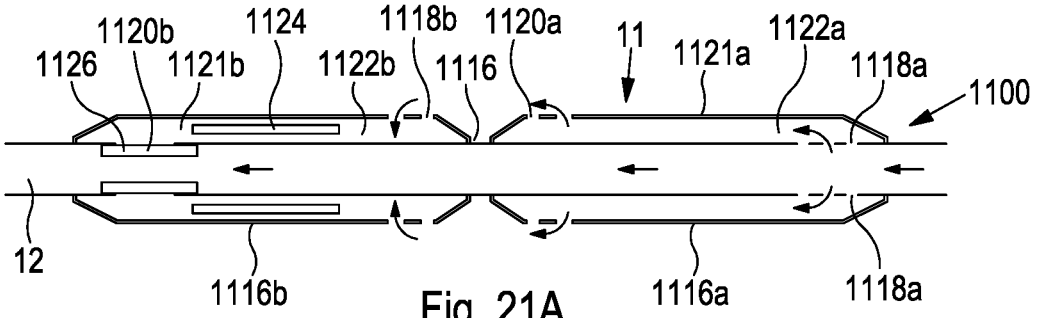
FIGS. 21A, 21B and 21C are enlarged sectional views of a tracer release apparatus with an outward venting section in fluid communication with the production tubing according to an embodiment of the invention showing operation steps for a long tracer release apparatus shut in in a well with a normally low production rate.
Figure 21B:
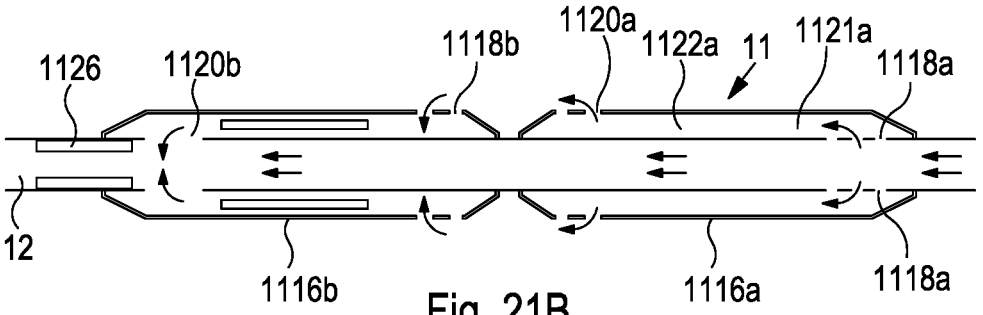
Figure 21C:
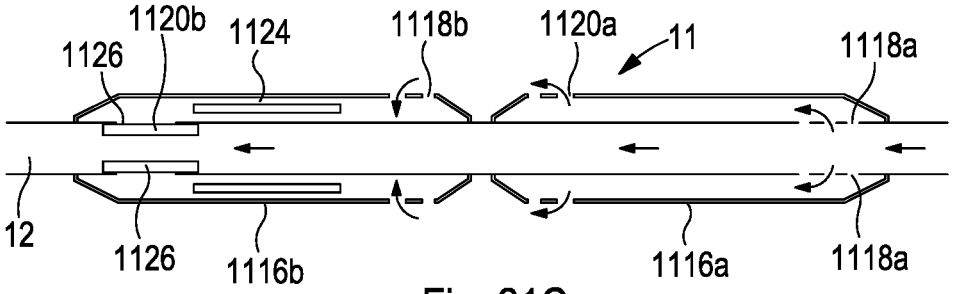

FIG. 21A to 21C show enlarged sections of a tracer release apparatus 1100. The tracer release apparatus is installed on a production tubing 12. The tracer release apparatus 1116 has an outward venting section 1116*a* with an inlet 1118*a* in fluid communication with the production tubing and an outlet 1120*a* in fluid communication with annulus 11. The outward venting section 1116*a* has an annulus chamber 1121*a* surrounding the production tubing with a fluid volume 1122*a* between inlet 1118*a* and outlet 1120*a*. The tracer release apparatus 1100 has an inward venting section 1116*b* with an inlet 1118*b* in fluid communication with the annulus 11 and an outlet 1120*b* in fluid communication with a production pipe 12. Arrows in FIGS. 21A to 21C denote the direction of fluid travel. The inward venting section 1116*b* has an annulus tracer chamber 1121*b* surrounding the production tubing with a fluid volume 1122*b* which comprises a tracer material 1124. The tracer material may be disposed in the tracer chamber to allow fluid to contact the tracer material and pass around the tracer material in the fluid volume 1122*b*. The tracer material 1124 is designed to release tracer molecules or particles when exposed to a target well fluid i.e. oil, gas or water.

A valve assembly 1126 is fixed with a movably closure member for selectively opening and closing the outlet aperture 1120*b* to control the flow of fluid from the tracer chamber 1121*b* to the production pipe.

In this example the valve assembly 1126 is a differential pressure operated valve designed to open and close in response to changes in differential pressure between the production tubing and the tracer release apparatus. In this case the change in differential pressure is controlled by adjusting the production flow rate. The valve assembly is set to open above a pre-set production flow rate threshold and close below the set threshold.

During normal production as shown in FIG. 21A the production flow rate is below the pre-set flow rate threshold and therefore the valve assembly remains closed. Fluid passes from the production pipe through inlet 1118*a* into the fluid volume 1122*a* of the annulus chamber 1121*a* and through outlet 1120*a* of the outward venting section 1116*a* into the annulus 11. Fluid enters the fluid volume 1122*b* of the inward venting section 1116*b* from the annulus 11 via inlet 1118*b*.

In fluid volume 1122*b* the tracer material is exposed to the target fluid and tracer particles are released into the fluid. Tracer material 1124 in the fluid volume remains exposed to a volume of fluid in the fluid volume 1122 over the period of time that the valve 1126 is closed, building up a high concentration of the tracer particles in the inner fluid volume of the tracer release apparatus.

When a tracer release operation is required, the choke assembly is temporarily adjusted to increase the production flow rate to a second flow velocity which it higher than the pre-set threshold for the valve 1126, the valve 1126 opens the outlet 1120*b* releasing the fluid and accumulated high concentration tracer cloud into the production tubing 12. Fluid flow via the deviated path of inlet 1118*a*, outlet 1120*a* of the outward venting section and via inlet 1118*b* gradually flushes out the high concentration of the tracer molecules from the fluid volume of the tracer chamber into the production tubing as a tracer cloud. The tracer cloud creates a high amplitude spike signal at a detection point followed by a decay curve of tracer signal which represents the gradually displacement and flush out of the tracer from the tracer release apparatus.

Figure 22A:
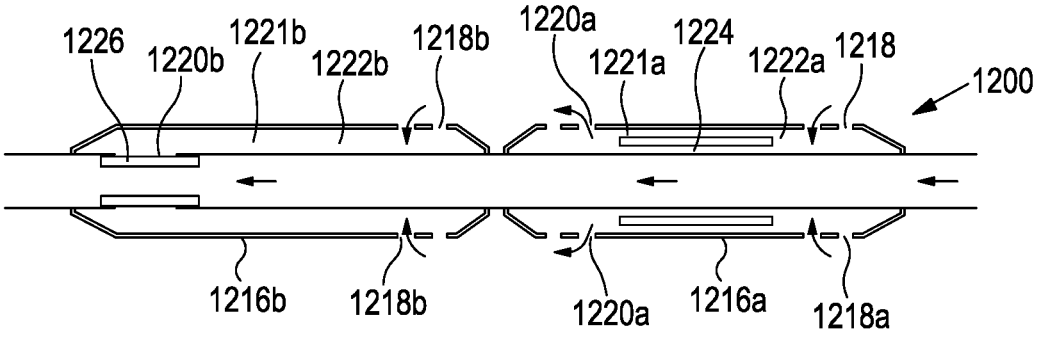
FIGS. 22A, 22B and 22C are enlarged sectional views of a tracer release apparatus with an outward venting section in fluid communication with the annulus according to an embodiment of the invention showing operation steps for a long tracer release apparatus shut in in a well with a normally low production rate.
Figure 22B:
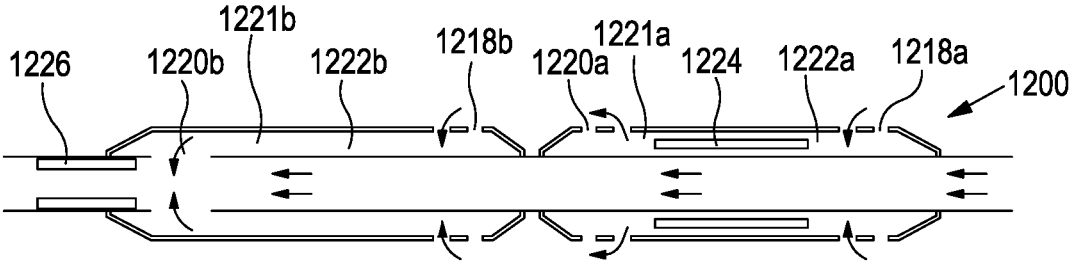
Figure 22C:
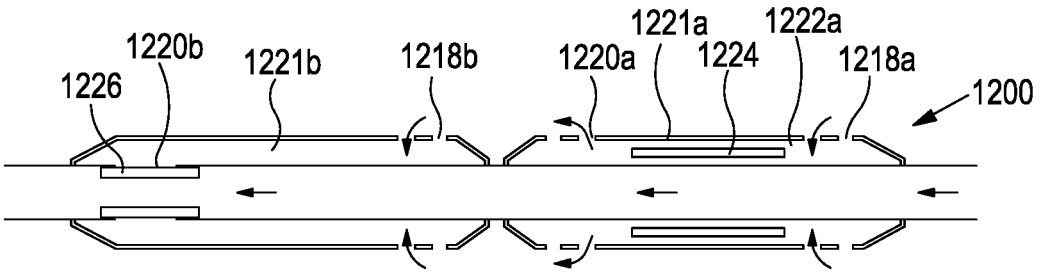

FIG. 22A to 22C are enlarged sections of a tracer release apparatus 1200. The tracer release apparatus is installed on a production tubing 12. The tracer release apparatus 1216 has an outward venting section 1216*a* with inlets 1218*a* and outlets 1220*a* in fluid communication with annulus 11. The outward venting section 1216*a* has an annulus tracer chamber 1221*a* surrounding the production tubing with a fluid volume 1222*a* which comprises a tracer material 1224. The tracer material is disposed in the tracer chamber to allow fluid to contact the tracer material and pass around the tracer material in the fluid volume 1222*a*. The tracer material 1224 is designed to release tracer molecules when exposed to a target well fluid i.e. oil, gas or water.

The tracer release apparatus 1200 has an inward venting section 1216*b* with inlets 1218*b* in fluid communication with the annulus 11 and outlets 1220*b* in fluid communication with a production pipe 12. Arrows in FIGS. 22A to 22C denote the direction of fluid travel. The inward venting section 1216*b* has an annulus chamber 1221*b* surrounding the production tubing with a fluid volume 1222*b* between inlet 1218*b* and outlet 1220*b*.

A valve assembly 1226 is fixed with a movably closure member for selectively opening and closing the outlet apertures 1220*b* to control the flow of fluid from the annulus chamber 1221*b* to the production pipe.

In this example the valve assembly 1226 is a differential pressure operated valve designed to open and close in response to changes in differential pressure between the production tubing and the tracer release apparatus. In this case the change in differential pressure is controlled by adjusting the production flow rate. The valve assembly is set to open above a pre-set production flow rate threshold and close below the set threshold.

During normal production as shown in FIG. 22A the production flow rate is below the pre-set flow rate threshold and therefore the valve assembly remains closed. Fluid passes from the annulus through inlet 1218*a* into the fluid volume 1222*a* of the annulus tracer chamber 1221*a* and through outlet 1220*a* of the outward venting section 1216*a* into the annulus 11.

In the fluid volume 1222*a* the tracer material is exposed to the target fluid and tracer molecules are released into the fluid.

Fluid enters the fluid volume 1222*b* of the inward venting section 1216*b* from the annulus 11 via inlet 1218*b*. The fluid with tracer molecules is prevented from entering the production tubing while the valve 1226 is closed.

When a tracer release operation is required, the choke assembly is temporarily adjusted to increase the production flow rate to a second flow velocity which it higher than the pre-set threshold for the valve 1226, the valve 1226 opens the outlet 1220*b* releasing the fluid and tracer molecules into the production tubing 12. The tracer enriched fluid is gradually flushed out of the fluid volume 1222*b* into the production tubing.

The released tracer creates a high amplitude spike signal at a detection point followed by a decay curve of tracer signal which represents the gradually displacement and flush out of the tracer from the tracer release apparatus.

In the above example tracer material is disposed in the annulus chamber 1221*a* of the outward venting section 1216*a*. However, it will be appreciated that tracer material may be alternatively or additionally may be disposed in the annulus chamber 1221*a* in the inward venting section 1216. In examples where tracer material is disposed in the outward venting section 1216*a* and inward venting sections the tracer material in the inward venting section may be same or different to the tracer material in the outward venting section.

In the above examples described in FIGS. 21A to 22C the tracer release apparatus is configured to shut in the tracer release apparatus during normal low production and release the high concentration of tracer by temporarily increasing the production flow rate. However it will be appreciated that the tracer release apparatus may alternatively be configured to shut in during normal high production in high production wells and release the tracer by temporarily decreasing the production flow rate.

It will also be appreciated the tracer release apparatus may be configured to allow release of tracer during normal production flow and to be temporarily shut in by adjusting the flow production flow rate.

It will be further appreciated that although the above examples described in FIGS. 21A to 22C have a valve disposed at the outlet 1220*b* of the tracer release operation, it will be understood from the above examples that valves may be positioned at any and/or all of the inlets and/or outlets of the tracer release apparatus. For examples valve assemblies may control the flow of fluid through outlets 1220*a* and/or 1220*b*. Alternatively or additionally valve assemblies may control the flow of fluid through inlets 1218*a* and/or 1218*b*. Additionally or alternatively the one or more valve assemblies may be actuated in response to a change of flow in the annulus.

The data collected at the detection point as described in the above examples may be analysed to identify the arrival of the concentration peaks of each tracer to determine the percent of inflow that occurs between tracer locations. The tracer locations may be known locations in the well geometry.

When the tracer is released from two or more tracer release apparatus to the surface their arrival at the surface is monitored and analysed to determine the inflow distribution. The volume between the arrival of each tracer peak may be proportional to the inflow that occurs upstream of each tracer.

The tracer transients are driven by the velocity field in the well. The topside arrivals of the tracers can be used to estimate the downhole velocity field. From the velocity field the inflow profile may be calculated. The concentration of tracers at surface as a function of time is related to the influx into the well, by the velocity field. The tracer concentrations are governed by the velocity field. The velocity field may be influenced by the well geometry and transport path of the fluid flow.

A model may be used based on the well geometry of the production well that assumes a specific scenario of inflow distribution, simulates the arrival time of the tracer peaks, and compares the simulated results to the actual peak arrivals. After several iterations, the model may converge on a solution that provides an inflow distribution that best fits the actual data. The model may include a model transport path corresponding to the actual well's transport path downstream of the influx zones.

The model should include an influx model corresponding to the real influx locations, a tracer system model and having even model leak or release rate corresponding to the real tracer sources and a model well transport path corresponding to the actual production well.

The tracer concentration may be calculated as a function of time. The measured tracer concentrations may be compared with modelled tracer concentrations to derive information about downhole inflow profiles.

Samples may be collected and/or measured downstream at known sampling times. Based on the measured tracer concentrations and their sampling sequence and the well geometry the influx volumes may be calculated. The influx volumes may be calculated from transient flow models.

The collection, detection, analysis and/or interpretation of tracer data in production fluid may be considered as separate methods from one another and performed at different times or jurisdictions. The detection, analysis and/or interpretation of tracer in production fluid may be separate methods to release of tracer cloud from the tracer release apparatus and/or the collection of samples.

In real time detection, the detection, analysis and/or interpretation of tracer data in production fluid may be considered as separate methods from one another and performed at different times or jurisdictions. The detection, analysis and/or interpretation of tracer in production fluid may be separate methods to release of tracer cloud from the tracer release apparatus and/or the collection of samples.

Model concentrations for each tracer material may be calculated in a modelled downstream well flow transport path as a function of time under a modelled transient occurring in the model.

Additionally or alternatively the data collected at the detection point as described in the above examples may be analysed to identify the rate of decline of the tracer concentration from each tracer location to determine the percent of reservoir inflow from each influx zone.

When the tracer is flushed out of the tracer release apparatus the zones with high inflow rates flush out the tracer faster than zones with low inflow rates, thereby preserving the high concentration of tracer molecules and generating a profile with steep rates of decline. Conversely the concentration of tracer molecules in the fluid that is flushed out from a low-performing zone becomes more diluted as it enters the main flow stream and travels to the surface. Consequently, the profile of the tracer concentration presents a less steep rate of decline when compared to a high-performing zone. The data may be analysed to compare the rate of decline in tracer concentration between each monitored zone and quantitatively determines the respective relative inflow rates.

Although the above examples describe the control and actuation of the at least one valve by differential pressure or changes in flow velocity, additional or alternatively the at least one valve may be electrically controlled and actuated. The at least one electrical valve may be controlled remotely by wired and/or wireless communication.

The invention provides a method of monitoring influx of a fluid to a hydrocarbon producing well comprising providing at least one tracer release apparatus in a hydrocarbon producing well at an influx location. The at least one tracer release apparatus comprises a fluid volume and a tracer material located in the fluid volume. The method comprises shutting in the tracer release apparatus during production to increase the concentration of tracer molecules in the fluid volume, releasing the tracer molecules from the tracer release apparatus into the production flow and detecting the presence of tracer downstream of the influx location.

The invention provides a method of monitoring influx of a fluid to a hydrocarbon producing well. The method comprises providing at least one tracer release apparatus connected to a production tubing in a hydrocarbon producing well at an influx location. The tracer release apparatus comprises a fluid volume, a tracer material located in the fluid volume, an outlet to the fluid volume, and a controllable valve configured to selectively control the flow of fluid through the at least one outlet. The tracer release apparatus has a first condition in which the controllable valve is closed to substantially or fully prevent fluid and tracer material from passing from the fluid volume to the production fluid via the outlet, and a second condition in which the controllable valve is open to enable fluid and tracer materials to pass from the fluid volume to the production tubing via the outlet. The the method comprises producing hydrocarbons from the well with the tracer release apparatus in its first condition at a first production flow rate in the production tubing. The method also comprises modifying the production flow rate in the production tubing to a second production flow rate to actuate the controllable valve to cause fluid and the tracer material to flow from the fluid volume to the production tubing, creating an increased concentration of tracer material in the production tubing and detecting the presence of tracer material downstream of the influx location.

The tracer release system may be able to selectively shut-in each tracer release apparatus located at or near an influx zone to build up and increase tracer molecules in the fluid in the tracer release apparatus. The tracer release system may be able to selectively release the increased concentration of tracer molecules as a tracer cloud from the tracer release apparatus into the production flow to create a detectable tracer spike at a detection point. This may allow flow measurement and wellbore inflow profiles to be calculated and monitored.

A benefit of the tracer release system is that is capable of selectively generating high concentrations of tracer molecules and releasing the tracer molecules from the release system without requiring the shutting in of the well.

Another benefit of the tracer release system is that is capable of releasing an increased or high concentration of tracer as a tracer cloud which can be detected in the production flow at surface. It also controls the exposure of the tracer material in the tracer release apparatus to the production fluid thereby extending the lifespan of the tracer downhole.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "downstream", "upstream" and the like are used herein to indicate directions and locations as they apply to the appended drawings and will not be construed as limiting the invention and features thereof to particular arrangements or orientations. Likewise, the term "outlet" shall be construed as being an opening which, dependent on the direction of the movement of a fluid and may also serve as an "inlet", and vice versa.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention as defined by the appended claims.

Various modifications to the above-described embodiments may be made within the scope of the invention, and the invention extends to combinations of features other than those expressly claimed herein.

The invention claimed is:

1. A method of monitoring influx of a fluid to a hydrocarbon producing well, the method comprising:

providing at least one tracer release apparatus in a hydrocarbon producing well at an influx location; wherein the at least one tracer release apparatus comprises:

a fluid volume; and a tracer material located in the fluid volume;

shutting in the tracer release apparatus during production to build a concentration of tracer molecules in the fluid volume;

releasing the tracer molecules from the tracer release apparatus into the production flow; and detecting the presence of tracer downstream of the influx location.

2. The method according to claim 1 comprising collecting samples of the production flow to detect the presence of tracer wherein the sampling is conducted at one or more sampling times.

3. The method according to claim 1 comprise detecting the presence of tracer in the production flow in real time.

4. The method according to claim 1 comprising detecting the presence of tracer downstream of the tracer release apparatus or at surface.

5. The method according to claim 1 comprising conducting optical monitoring for detection of the tracers in the production flow.

6. The method according to claim 1 comprising analysing the arrival of concentration peaks of each tracer to determine the percent of inflow that occurs between tracer locations.

7. The method according to claim 1 comprising analysing a rate of decline of the tracer concentration from each tracer location to determine the percent of reservoir inflow from each influx zone.

8. The method according to claim 1 wherein the tracer release apparatus comprises a controllable valve and the method comprises modifying the production flow rate in a production tubing to actuate the controllable valve to shut in the tracer release apparatus or to release the high concentration of tracer molecules from the tracer release apparatus.

9. The method according to claim 1 comprising temporarily modifying a production flow rate to a higher or lower production flow rate to shut in the tracer release apparatus or to release the high concentration of tracer molecules from the tracer release apparatus.

10. The method according to claim 1 comprising detecting the tracer by techniques selected from the group comprising optical detection, optical fibers, spectrophotometric methods, PCR techniques combined with sequential analysis, chromatographic methods and radioactivity analysis.

11. The method according to claim 1 providing two or more tracer release apparatus connected to a production tubing in a hydrocarbon producing well each tracer release apparatus at a different influx location.

12. A system for monitoring influx of a fluid to a producing petroleum well comprising:

at least one probe;

at least one tracer release apparatus for connection to a production tubing, the at least one tracer release apparatus comprising:

at least one outlet;

at least one tracer chamber in fluid communication with the at least one outlet;

a tracer material located in the tracer chamber; and at least one valve configured to selectively control the flow of fluid through the at least one outlet;

wherein the at least one valve is configured to shut in the tracer release apparatus during production to increase the concentration of tracer molecules in a fluid volume in the tracer chamber.

13. The system according to claim 12 wherein the valve is configured to shut in the tracer release apparatus for a period of time sufficient to build up a high concentration of tracer molecules that is detectable as a high amplitude tracer response signal at the detection point downstream when the tracer particles or molecules are released from the tracer release apparatus.

14. The system according to claim 12 wherein the at least one tracer release apparatus comprises at least one inlet in fluid communication with the at least one tracer chamber.

15. The system according to claim 12 wherein the at least one valve is configured to open and close to intermediate positions between the fully open and fully closed position to selectively control the flow of fluid through the at least one outlet.

16. The system according to claim 12 wherein the tracer material is configured to release tracer molecules from the tracer material into a fluid in the tracer chamber on contact with a target well fluid.

17. The system according to claim 12 wherein the tracer material comprises a luminescent dye.

18. The system according to claim 12 wherein the at least one valve is an electrically operated valve, a differential pressure operated valve or a velocity valve.

19. The system according to claim 12 comprising at least one flow restriction device.

20. The system according to claim 12 wherein the at least one tracer release apparatus is configured to be retrofitted into an existing tubing or a component of the at least one tracer release apparatus adjusted by wireline, slickline, coiled tubing, drill pipe or similar conveyance.

21. The system according to claim 12, wherein the at least one probe is a sample collection probe, a detector probe or a real time detector probe.

22. A method of estimating an influx profile for at least one of the well fluids to a producing well with two or more influx zones to a production flow comprising arranging two or more tracer release apparatus connected to the production tubing at known levels of the well;

wherein each tracer release apparatus comprises;

at least one outlet;

at least one tracer chamber in fluid communication with at least one outlet;

a distinct tracer material located in the at least one tracer chamber;

at least one valve configured to selectively control the flow of fluid through the at least one outlet;

shutting in the tracer release apparatus during production to increase the concentration of tracer molecules in the fluid volume;

opening the at least one valve in each tracer release apparatus to release tracer molecules from the tracer chamber into the production flow though the at least one outlet; and measuring the concentration of tracer and estimating an influx profile for at least one of the well fluids based on the type of tracer and measured tracer concentrations.

23. The method according to claim 22 comprising analysing characteristics of the tracer release, sampling time, or cumulative produced volume of the influx volumes from different influx zones.

24. The method according to claim 22 comprising closing at least one valve for a period of time to shut in the tracer release apparatus.

25. The method according to claim 22 comprising opening at least one valve on each of the two or more tracer release apparatus at substantially the same time.

26. A method of collecting samples for analysis in estimating an influx profile of a hydrocarbon producing well, the well comprising at least one tracer release apparatus connected to a production tubing in a hydrocarbon producing well at an influx location, the tracer release apparatus comprising a fluid volume; a tracer material located in the fluid volume; an outlet to the fluid volume; and a controllable valve configured to selectively control the flow of fluid through the at least one outlet; the method comprising:

inducing a transient in the production flow to release at least one tracer from the at least one tracer release apparatus; and collecting samples at a location downstream of the tracer sources after inducing the transient in the production flow.

27. The method according to claim 26, wherein the at least one tracer release apparatus includes an inlet to the fluid volume which allows fluid to enter the fluid volume and mix with the tracer material such that a concentration of the tracer material will build up in the fluid in the fluid volume while the controllable valve remains closed.

* * * * *